US006623143B2

(12) United States Patent
Anderson

(10) Patent No.: US 6,623,143 B2
(45) Date of Patent: Sep. 23, 2003

(54) CEILING REFLECTORS

(75) Inventor: Douglas J. Anderson, South Elgin, IL (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 09/898,851

(22) Filed: Jul. 3, 2001

(65) Prior Publication Data

US 2002/0085374 A1 Jul. 4, 2002

Related U.S. Application Data

(60) Provisional application No. 60/216,401, filed on Jul. 6, 2000.

(51) Int. Cl.[7] ..... F21V 7/00

(52) U.S. Cl. ..... 362/297; 362/518; 362/346

(58) Field of Search ..... 362/516–518, 362/296–297, 304, 305, 346–350

(56) References Cited

U.S. PATENT DOCUMENTS

| | | | | |
|---|---|---|---|---|
| 330,742 | A | | 11/1885 | Scovil et al. |
| 678,942 | A | | 7/1901 | Cox |
| 823,392 | A | | 6/1906 | Burnfield |
| 1,224,189 | A | | 5/1917 | Maltby |
| 1,235,274 | A | | 7/1917 | Wood |
| 1,292,637 | A | | 1/1919 | Patch |
| 1,365,319 | A | | 1/1921 | Hazard |
| 1,478,564 | A | | 12/1923 | Hallett |
| 1,639,363 | A | | 8/1927 | Balsillie |
| 1,658,265 | A | | 2/1928 | Thompson |
| 1,732,884 | A | | 10/1929 | Foster |
| 1,814,326 | A | | 7/1931 | Melton |
| 1,903,330 | A | | 4/1933 | Young et al. |
| 1,913,518 | A | | 6/1933 | Smith et al. |
| 1,950,380 | A | | 3/1934 | Arras |
| 2,274,405 | A | | 2/1942 | Flaherty |
| 3,638,010 | A | | 1/1972 | Moore |
| 3,758,770 | A | | 9/1973 | Morasz |
| 4,028,542 | A | | 6/1977 | McReynolds, Jr. |
| 4,112,483 | A | | 9/1978 | Small, Jr. et al. |
| 4,293,900 | A | | 10/1981 | Dziubaty |
| 4,308,573 | A | | 12/1981 | McNamara, Jr. |
| 4,310,876 | A | | 1/1982 | Small, Jr. et al. |
| 4,409,646 | A | | 10/1983 | Baliozian |
| 4,447,865 | A | | 5/1984 | VanHorn et al. |
| 4,481,563 | A | | 11/1984 | Snyder et al. |
| 4,494,176 | A | | 1/1985 | Sands et al. |
| 4,544,999 | A | | 10/1985 | Kawanami et al. |
| 4,575,788 | A | | 3/1986 | Lewin |
| 4,633,377 | A | | 12/1986 | Mackiewicz |
| 4,704,661 | A | | 11/1987 | Kosmatka |
| 4,754,375 | A | | 6/1988 | Ferenc |
| 4,905,133 | A | | 2/1990 | Mayer et al. |
| 4,928,214 | A | | 5/1990 | Oyama |
| 5,034,867 | A | | 7/1991 | Mayer |
| 5,249,110 | A | | 9/1993 | Russello et al. |
| 5,251,116 | A | | 10/1993 | Wijbenga et al. |
| 5,303,126 | A | | 4/1994 | Taniuchi |
| 5,305,189 | A | | 4/1994 | Sekiguchi |
| 5,390,095 | A | * | 2/1995 | Lemons et al. ..... 362/301 |
| 5,416,683 | A | | 5/1995 | McCarthy |
| 5,418,420 | A | | 5/1995 | Roberts |
| 5,426,575 | A | | 6/1995 | Richards |
| 5,448,462 | A | | 9/1995 | Moran, III |
| 5,475,361 | A | | 12/1995 | Curran et al. |
| 5,931,569 | A | | 8/1999 | Anderson |

* cited by examiner

*Primary Examiner*—Sandra O'Shea
*Assistant Examiner*—Guiyoung Lee
(74) *Attorney, Agent, or Firm*—Welsh & Katz, Ltd.

(57) ABSTRACT

A strobe unit includes a light source carried by a reflector. The reflector has a plurality of reflecting regions arranged around the light source, each reflecting region including a partial parabolic section extruded linearly in a first direction, and a plurality of parabolic aiming sections extruded to a point and arranged between adjacent partial parabolic sections. The parabolic aiming sections are arranged to direct light from the light source substantially in a radial plane substantially parallel to the first direction. The reflector can also include a planar section arranged between the partial parabolic section and the parabolic aiming sections.

51 Claims, 22 Drawing Sheets

CEILING REFLECTORS

This application is a non-provisional application claiming benefit of prior filed provisional application U.S. Ser. No. 60/216,401 filed Jul. 6, 2000.

FIELD OF THE INVENTION

The invention pertains to strobe units that emit high intensity pulses of radiant energy over wide viewing fields. More particularly, the invention pertains to a strobe unit intended to be mounted to an overhead surface and having a reflector, wherein a light source extends from the reflector, the reflector shaped and arranged to reflect light in vertical, oblique and horizontal directions.

BACKGROUND

High intensity strobe units for emitting pulses of radiant energy over large viewing angles are known. Such structures, for example, are disclosed in Moran U.S. Pat. No. 5,448,462, and Anderson U.S. Pat. No. 5,931,569.

While known units provide appropriate levels of visible radiant energy over wide angles, such as would be used to visually indicate a fire alarm, it would be desirable to be able to improve the efficiency of such units and reduce the electrical power required to drive such units. Reduction of electrical power, if achievable, is particularly important in that more strobe units can be driven from the same size power supply, using the same size distribution cables, than would heretofore be feasible.

In addition to reducing the amount of energy needed to energize a given unit, it would be desirable to provide as much light as possible, expanding the light output field without introducing undue complexity into the structure of the unit.

SUMMARY OF THE INVENTION

In accordance with the invention a strobe unit includes a reflector and a source of radiant energy, such as a light source, the source mounted close to the reflector. When the light source is energized by the electronic drive circuitry, it emits pulses of light which can be viewed by an individual in the vicinity of the housing. Additionally, the source emits light which is reflected by the reflector before being viewable by the individual. The reflector is intended to be mounted to a ceiling surface and is configured to reflect light effectively downwardly and radially to cover a 360 degree field.

The reflector has a plurality of reflecting regions arranged around the light source. The light source is preferably elongated in a first direction perpendicular to the mounting surface. According to one aspect of the invention, each reflecting region includes multiple reflecting sections. The sections include a partial parabolic section or surface extruded linearly substantially in the first direction, and a plurality of parabolic aiming sections or surfaces are extruded or projected linearly to a point at an acute angle to the mounting surface and arranged rotationally between partial parabolic sections of adjacent reflecting regions. The partial parabolic section is arranged to direct light radially outwardly and also in the first direction. The parabolic aiming sections are arranged to direct light from the light source generally obliquely to the first direction.

According to another aspect of the invention, each reflecting region can also include a planar or flat section or surface arranged adjacent to the partial parabolic section, between the partial parabolic section and the parabolic aiming sections, located within that region. The partial parabolic section and the flat section are located at a predetermined angle with respect to the elongated light source. The flat section can be planar and extend at an angle of about 65–75° to the axis of the light source, 15–25 degrees relative to the mounting surface, and having its slope direction (line of maximum slope) parallel to, but slightly offset from, a radial plane that includes the central axis of the light source. The flat section reflects light out from the strobe unit in substantially the first direction and the radial direction.

According to a further aspect of the invention, each reflecting region can also include a raised parabolic aiming section spaced from the partial parabolic section and having a surface for directing light obliquely in a direction substantially toward the partial parabolic section, preferably in the compound 45° direction .

The reflector reflecting regions can include four identical reflecting regions wherein the regions are contiguously positioned around a central axis. Preferably, the central axis of the reflector is co-linear with a central axis of the light source. Advantageously, each partial parabolic section has a height which is comparable to the length of the elongated light source. Each partial parabolic section is tilted slightly back from a radial plane that includes the central axis of the light source at an angle of about 2 to 3 degrees.

The light source is preferably located at a focal point of the partial parabolic sections. The parabolic aiming sections can be linearly projected obliquely to a point on, or near to, the central axis of the light source. The parabolic aiming sections can comprise differing partial parabolic surfaces arranged contiguously in a series. Each parabolic aiming section can be configured to reflect light at a selected range of angles, relative to a plane containing the central axis.

The parabolic aiming sections can be geometrically constructed by sweeping or projecting diminishing-size partial parabolic curves or cross sections linearly along lines of projection to an origin point on the central axis of the light source.

In an alternate embodiment, the reflector includes a partial parabolic section as described in the first embodiment. The reflector includes a hybrid reflecting region adjacent to, and generally perpendicular to, the partial parabolic section. The hybrid region is formed by a partial parabolic curve having its focal axis coincident with the central axis of the reflector and transitioning at its outer edge into an oblique radial line. The curve and line are rotated about the central axis to form a hybrid surface comprising a parabolic trough and a conical section. A parabolic aiming section is located adjacent to the hybrid region and is formed by a partial parabolic curve projected obliquely radially to the reflector origin, blended along its contiguous side into the hybrid region.

The reflecting regions of either embodiment each form a substantially L-shaped module with the partial parabolic section being an upstanding leg, and the parabolic aiming sections and/or the planar section being the respective generally perpendicular leg.

The strobe unit can include a ceiling-mountable housing. The housing includes a light output opening covered by a transparent lens. The reflector is mounted within the output opening, beneath the lens. Electronic drive circuitry can be carried within the housing. The elongated light source, which has first and second displaced ends along the central axis, can be mounted directly to the reflector, beneath the lens. A bulb holder can be arranged to support an outer end of the bulb. Reflecting surfaces of each of the reflecting sections can be formed by plastic walls coated with a highly reflective material.

When the bulb is energized, the strobe unit produces a light output profile that meets or exceeds outstanding UL requirements.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
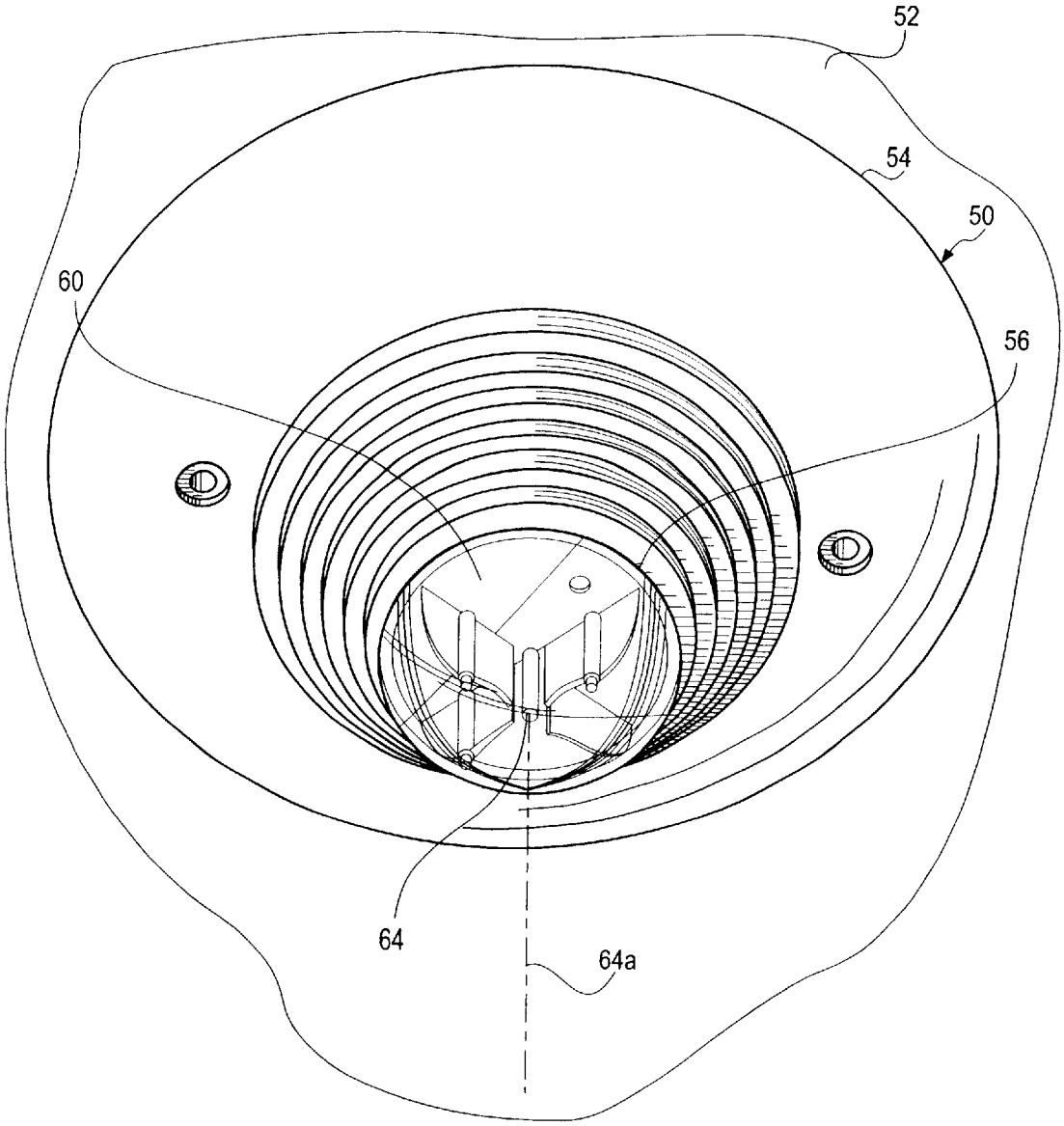
FIG. 1 is a perspective view of a strobe unit in accordance with the present invention, mounted to a ceiling.

While this invention is susceptible of embodiment in many different forms, there are shown in the drawings, and will be described herein in detail specific embodiments thereof with the understanding that the present disclosure is to be considered as an exemplification of the principles of the invention and is not intended to limit the invention to the specific embodiments illustrated.

FIG. 1 illustrates a strobe unit or module 50 mounted to a ceiling 52. The strobe unit 50 includes a housing 54, a lens 56, a reflector 60, and a source of light, such as a light bulb 64. In the exemplary embodiment, the bulb is elongated along a central axis 64*a* perpendicular to the ceiling 52. The housing can contain electronics, a power supply, and signal generating electronics and/or receiving electronics (not shown).

Figure 2:
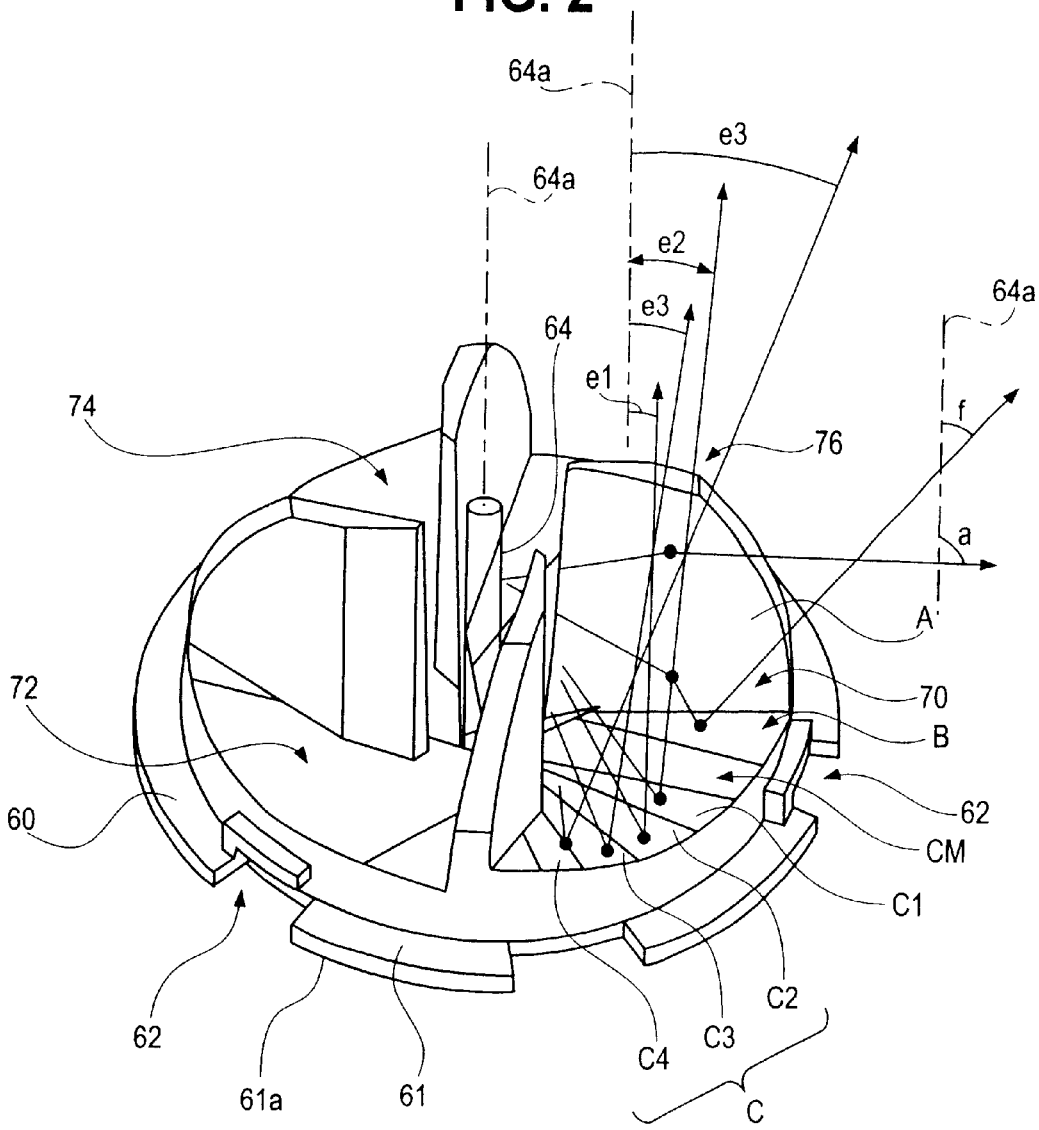
FIG. 2 is a perspective view of a reflector of the strobe unit of FIG. 1, shown in an inverted orientation for convenience of description.
Figure 3:
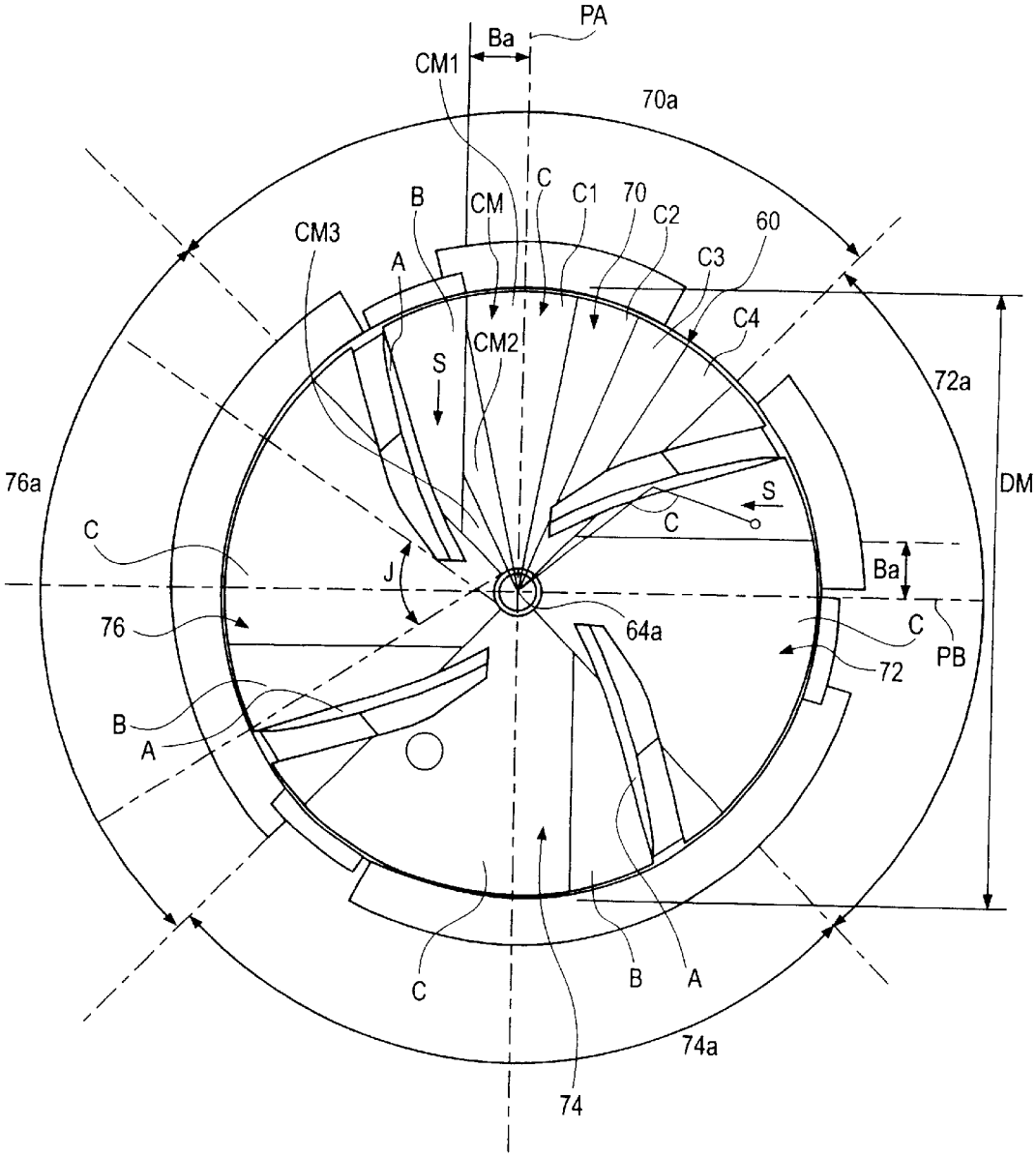
FIG. 3 is a plan view of the reflector of FIG. 2, shown with a light source installed.

FIGS. 2 through 3 show the reflector 60 and the bulb 64 assembled together, separated from the housing 54 and inverted for ease of description. The reflector 60 includes an annular base 61 having a mounting surface 61*a* and bayonet regions 62 for engaging the housing 54 to be retained thereby. The reflector 60 has plural reflecting regions, such as quadrants 70, 72, 74, 76. Each quadrant extends across a respective angle 70*a*, 72*a*, 74*a*, 76*a* (FIG. 3) from the central axis 64*a*.

Each quadrant includes three major reflecting sections or surfaces: a partial parabolic section or surface A, a flat section or surface B, a mirror image aiming parabolic section CM, and an aiming parabolic section or surface C. The reflecting sections or surfaces can be formed by plastic walls coated with a highly reflective material. The quadrants are replicated contiguously around the central axis 64*a*. The elongated bulb 64 is located along the central axis 64*a*, as illustrated in FIG. 3.

The partial parabolic surface A reflects light out the side of the reflector generally in radial cross planes PA or PB (shown in FIG. 3). The cross planes PA and PB are perpendicular and both include the central axis 64*a*. The partial parabolic surface A can also reflect light in other directions. The partial parabolic surface A is configured to have its focal point correspond to the location of the light source. This partial parabolic surface is elongated ore projected linearly along a direction slightly tilted from the first direction. Preferably, each partial parabolic section is tilted slightly back from a corresponding radial plane PA or PB at an angle of about 2 to 3 degrees, preferably about 2.5 degrees.

As shown in FIG. 2, the surface A of each region reflects light directly from the bulb generally in radial planes PA or PB, respectively, at angles a in a range of 30° to 90°, relative to the axis 64*a* of the bulb.

Figure 8:
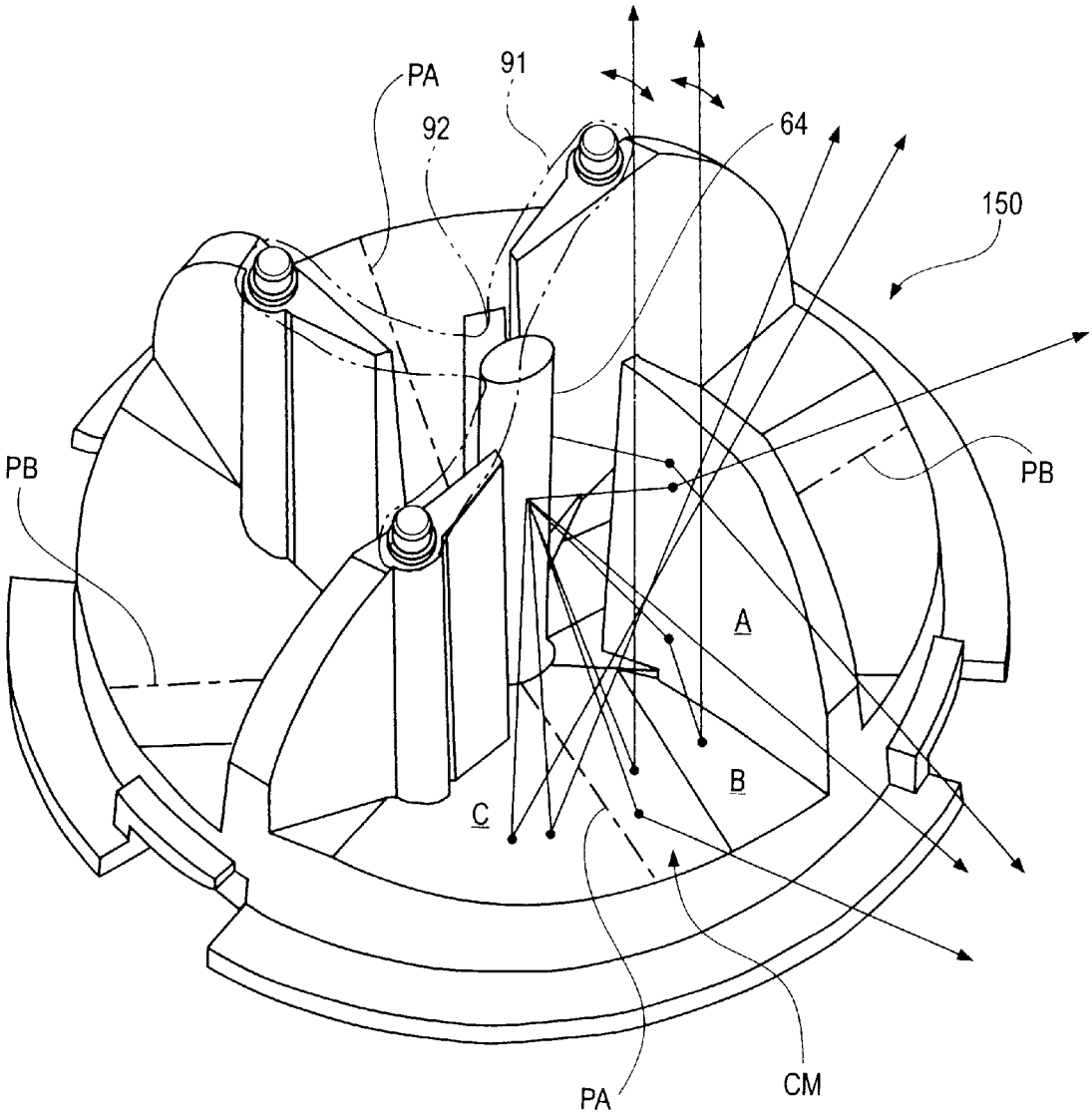
FIG. 8 is a perspective view of the reflector of FIG. 2 illustrating representative light rays and reflection paths.

The partial parabolic surface A is formed on an upstanding reflector wing 90. As shown in FIG. 8 for example, one or more of the wings 90 can serve the additional function of being a support point for a spider or centering bracket 91 (shown dashed) that supports an upper contact or lead 92 of the elongated light source 64.

Figure 10:
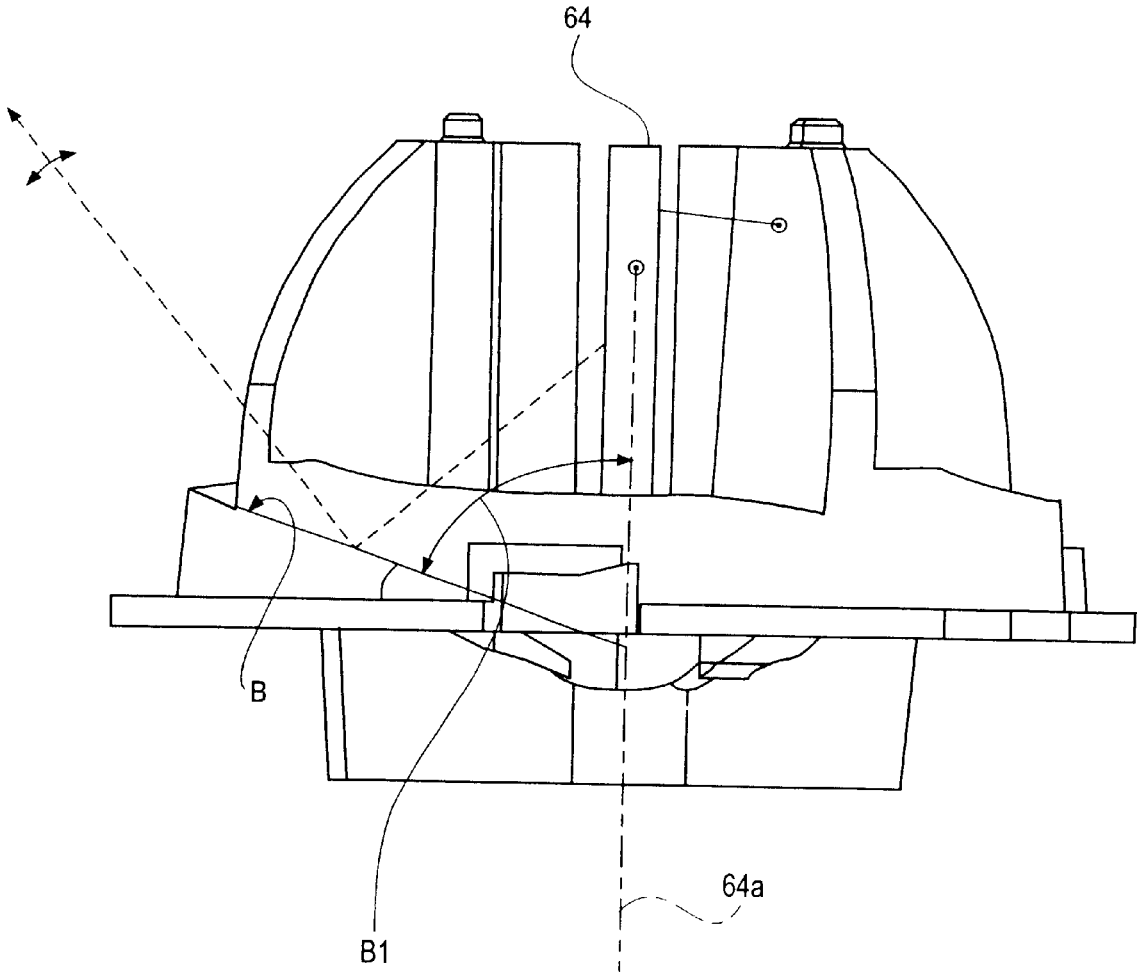
FIG. 10 is an elevational view of the reflector shown in FIG. 9 illustrating representative light rays and reflection paths.

Surface B reflects light out from the reflector in plane PA or plane PB respectively (as shown in FIG. 10). Surface B is a reflective plane oriented at an oblique angle B1 relative to the central axis 64*a*. Preferably, the sloping angle B1 is between about 65 and 75 degrees, more particularly between about 68 and 69 degrees. Surface B reflects light reflected from Surface A generally in planes PA or PB at an angle f in a range of 0° to 75° relative to the axis 64*a* of the bulb. The surface B has its slope direction S (line of maximum slope) parallel to, but slightly offset from, a corresponding radial plane PA or PB. For a reflector having a diameter DM (see FIG. 3) equal to 1.9 inches, surface B preferably is offset by a distance Ba, preferably about 0.18 inches, from the respective plane PA or PB.

Section CM is a multi-element structure which includes, as illustrated in FIG. 3, aiming parabolic surfaces CM1, CM2, CM3.

Section C is a multi-element structure which includes, as illustrated in FIGS. 2 and 3, aiming parabolic surfaces C1, C2, C3, and C4.

Section CM is a mirror image surface of the section C across the respective separating radial plane PA or PB. To define the sections C and CM, the section C will be defined first and the section CM is derived therefrom.

Figure 2A:
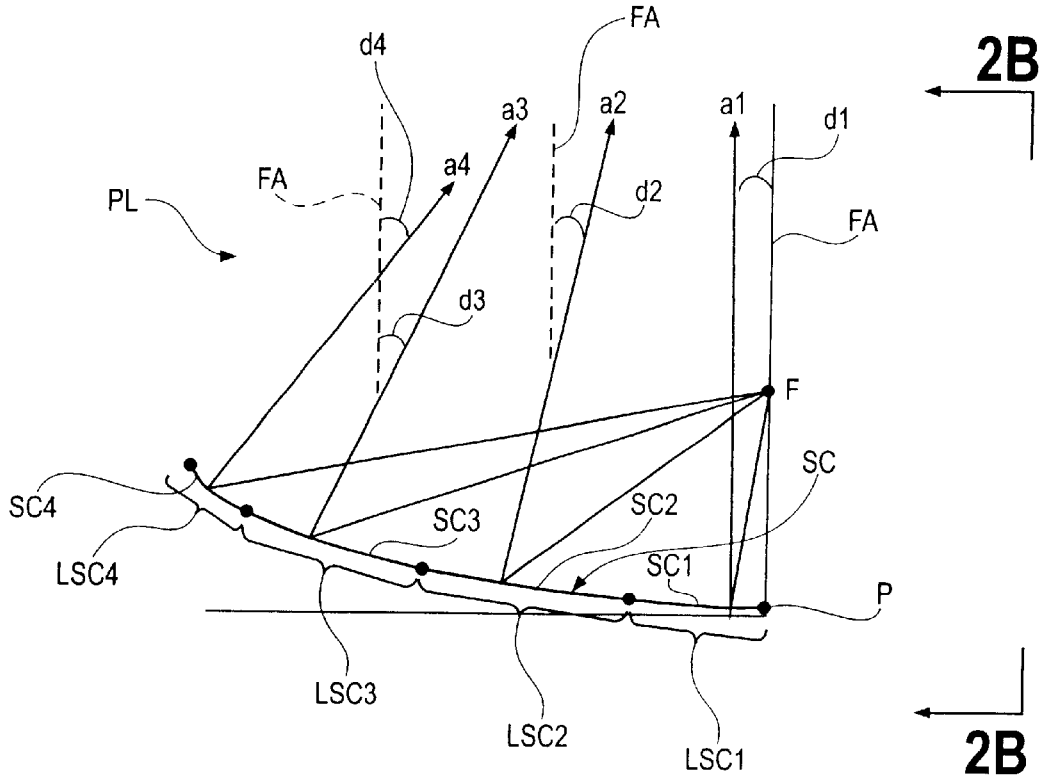
FIG. 2A is a diagrammatic view of a complex curve used to define a portion of the strobe unit shown in FIG. 2.

FIG. 2A illustrates a first step in defining the surfaces C1, C2, C3, C4 and then the surfaces CM1, CM2, CM3. The surfaces C1, C2, C3, C4 are defined first and the surfaces CM1, CM2, CM3 are mirror images of C1, C2, C3 across the respective radial plane PA or PB but which are terminated along an edge of the flat surface B. A complex curve is formed by partial parabolic curves sc1, sc2, sc3, sc4 which are arranged contiguously in series from a starting point P . The curves sc1, sc2, sc3, sc4 have a common parabolic focal point F on a focal axis FA. The curves sc1, sc2, sc3, sc4 have aiming directions a1, a2, a3, a4, respectively, given that a light ray from the focal point F will be reflected in the respective aiming direction from each of the curves. For a reflector having the diameter DM (see FIG. 3) equal to 1.9 inches, a bulb length of about 1 inch, the distance between P and F is about 1.1 inches. The chord lengths, the straight line distances between the beginning and end of each parabolic curve in the plane of FIG. 2A, of the curves sc1, sc2, sc3, sc4, respectively, are about: Lsc1=0.32 in.; Lsc2=0.32 in.; Lsc3=0.32 in.; and Lsc4=0.1 in.

The curves sc1, sc2, sc3, sc4 are preferably shaped to have aiming directions a1, a2, a3, a4 oriented at angles d1, d2, d3, d4 respectively, with respect to the focal axis FA. The angle d1 is preferably about 0°, the angle d2 is preferably about 10°, the angle d3 is preferably about 20°, and the angle d4 is preferably about 30°.

Figure 2B:
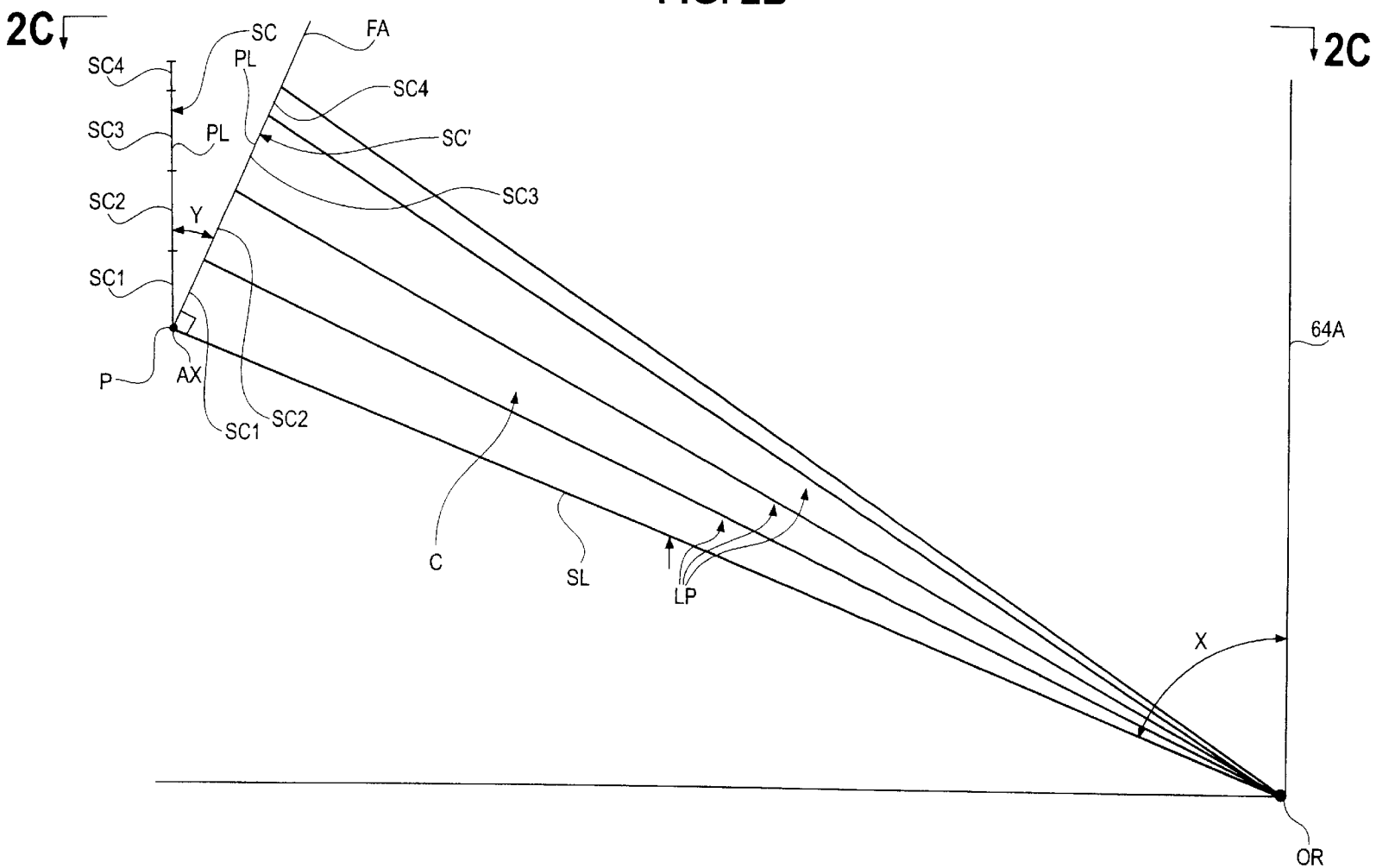
FIG. 2B is a diagrammatic side view taken along line 2B—2B of FIG. 2A.

FIG. 2B illustrates the next step in geometrically defining the surface C. The complex curve SC is viewed in profile along line 2B—2B of FIG. 2A. The complex curve SC and the focal axis FA are first positioned vertically, parallel to the bulb axis 64*a*, and elevated with respect to the bulb base or origin point OR. A sweep line SL is defined between the point P and the origin point OR. The sweep line SL is located in the respective radial plane PA or PB. A plane PL which contains the complex curve SC is then tilted toward the bulb axis by rotation about a pivoting axis AX (directed into the page) that contains the point P and is horizontal and perpendicular to the sweep line SL. The plane PL is tilted from its initial vertical orientation by an angle Y; Y preferably being about 30°. The point P is at a sufficient elevation with respect to the origin point OR on the bulb axis such that the sweep line SL is oriented 90 degrees to the focal axis FA and the plane PL, and the sweep line SL is oriented at an angle X from the bulb axis 64*a*. Preferably, the angle X is about 60°.

Figure 2C:
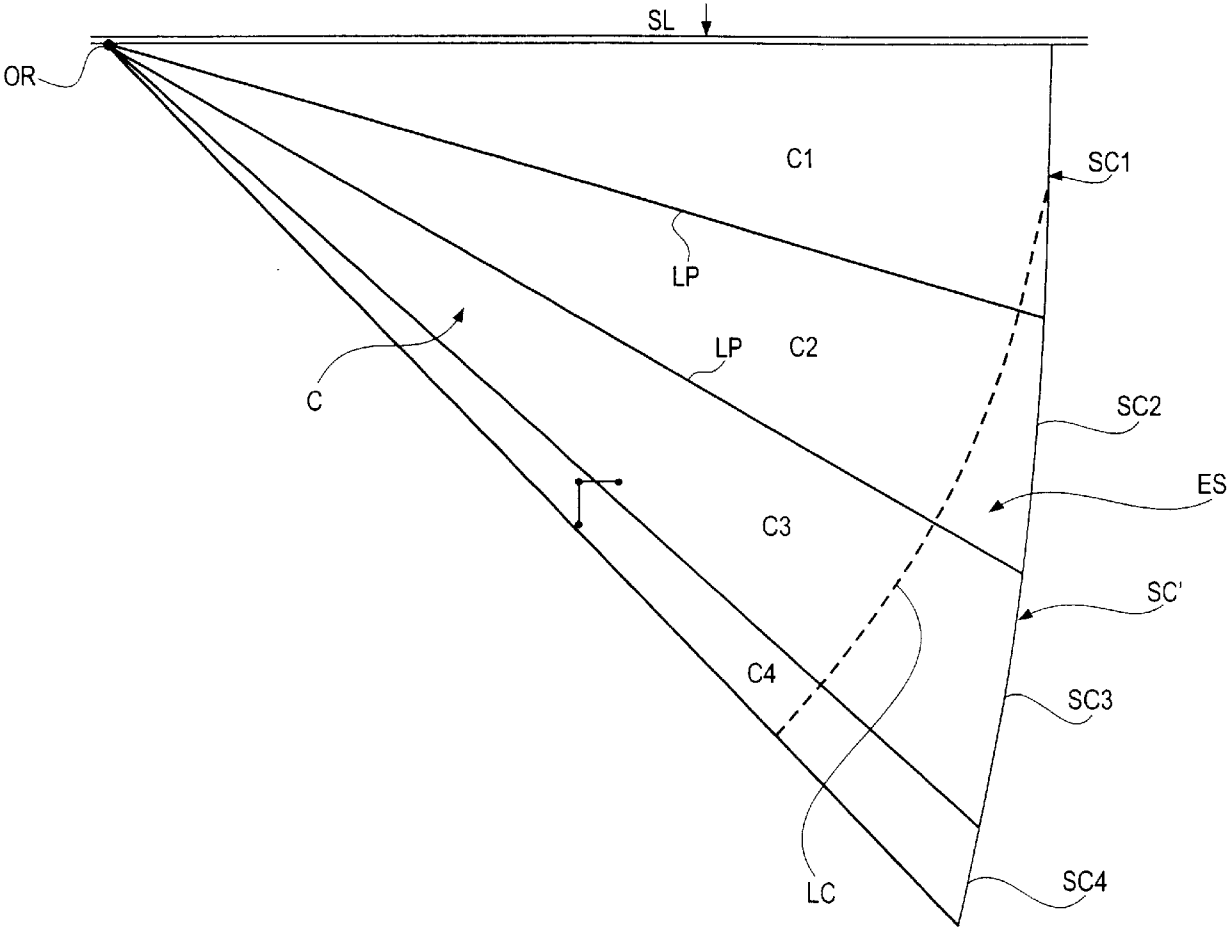
FIG. 2C is a diagrammatic top view taken along line 2C—2C of FIG. 2B.

The partial parabolic curves sc1, sc2, sc3, sc4, are swept linearly, i.e., along oblique radial lines of projection LP, in effect defining linearly diminishing-size partial parabolic cross sections, to the origin point OR (or near to the point OR) on the source central axis 64*a*, defining the surfaces C1, C2, C3, C4 (plus some excess surface ES which is removed as described with regard to FIG. 2C), respectively. Although only a few oblique radial lines of projection LP are indicated, it is to be understood that an infinite number of such lines define the sections C1, C2, C3, C4 and the section C.

FIG. 2C illustrates a further step in geometrically defining the section C. FIG. 2C illustrates the section C from a view taken along line 2C—2C of FIG. 2B. In order to create the section C which fits within a circular perimeter of the reflector diameter DM, a circular limit curve LC is geometrically "cut" to remove or trim some excess surface ES.

Figure 4:
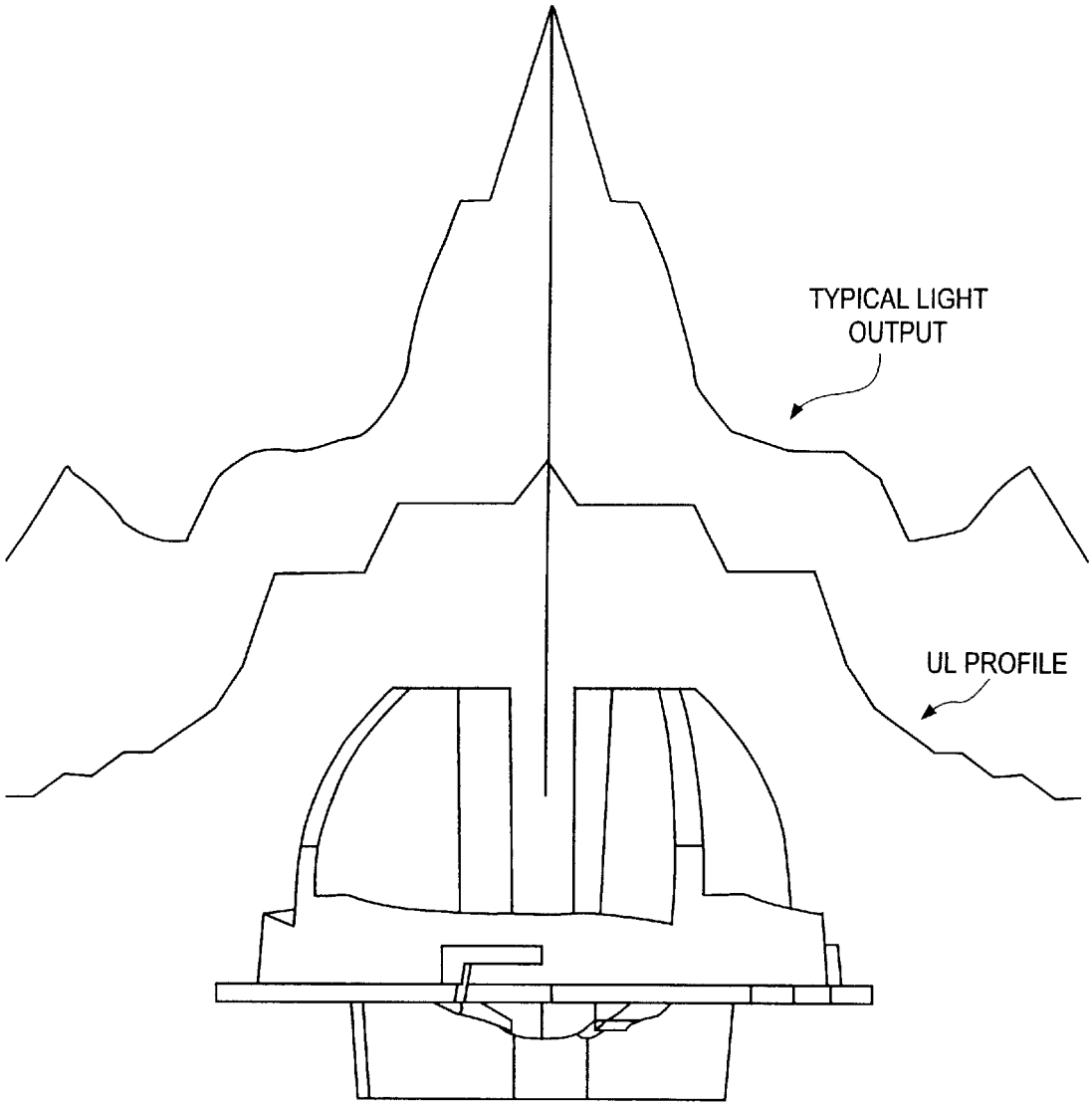
FIG. 4 is an elevational view of the strobe unit of FIG. 1 illustrating light output in one central vertical plane.

The surfaces C1, C2, C3, and C4, thus defined, contribute light to different parts of the total light profile as illustrated in FIG. 4. Section C reflects light directly from the bulb in planes PA and PB at an angle in a range of 0° to 75° relative to the axis 64*a*.

As illustrated in FIG. 2, the aiming surface C1 reflects light at angles e1 ranging from about 0° to 75°. The aiming surface C2 reflects light at angles e2 ranging from 0° to 10° relative to the axis 64*a*. Surfaces C3, C4 split a second bulb image and reflect light from that image at angles e3 ranging from 10° to 30° relative to the central axis 64*a*. The aiming surfaces C1, C2 widen the bulb reflection to create a bulb image as wide as the respective sections.

The section CM extends rotationally from the respective radial plane PA or PB that separates the sections C, CM, toward the flat surface B and terminates along the intersection of the flat surface B. The surfaces CM1, CM2 and CM3, to the extent that they are present, reflect light substantially in the same fashion as mirror image surfaces C1, C2, C3.

Also, as illustrated in FIG. 3 and demonstrated in quadrant 76, each quadrant 70, 72, 74, 76 allows direct viewing of the bulb 64 in a radial direction of about 65 degrees, although the structure of the quadrants could be configured to allow for an angle J in a range of angles J between about thirty degrees to about ninety degrees.

Figure 5:
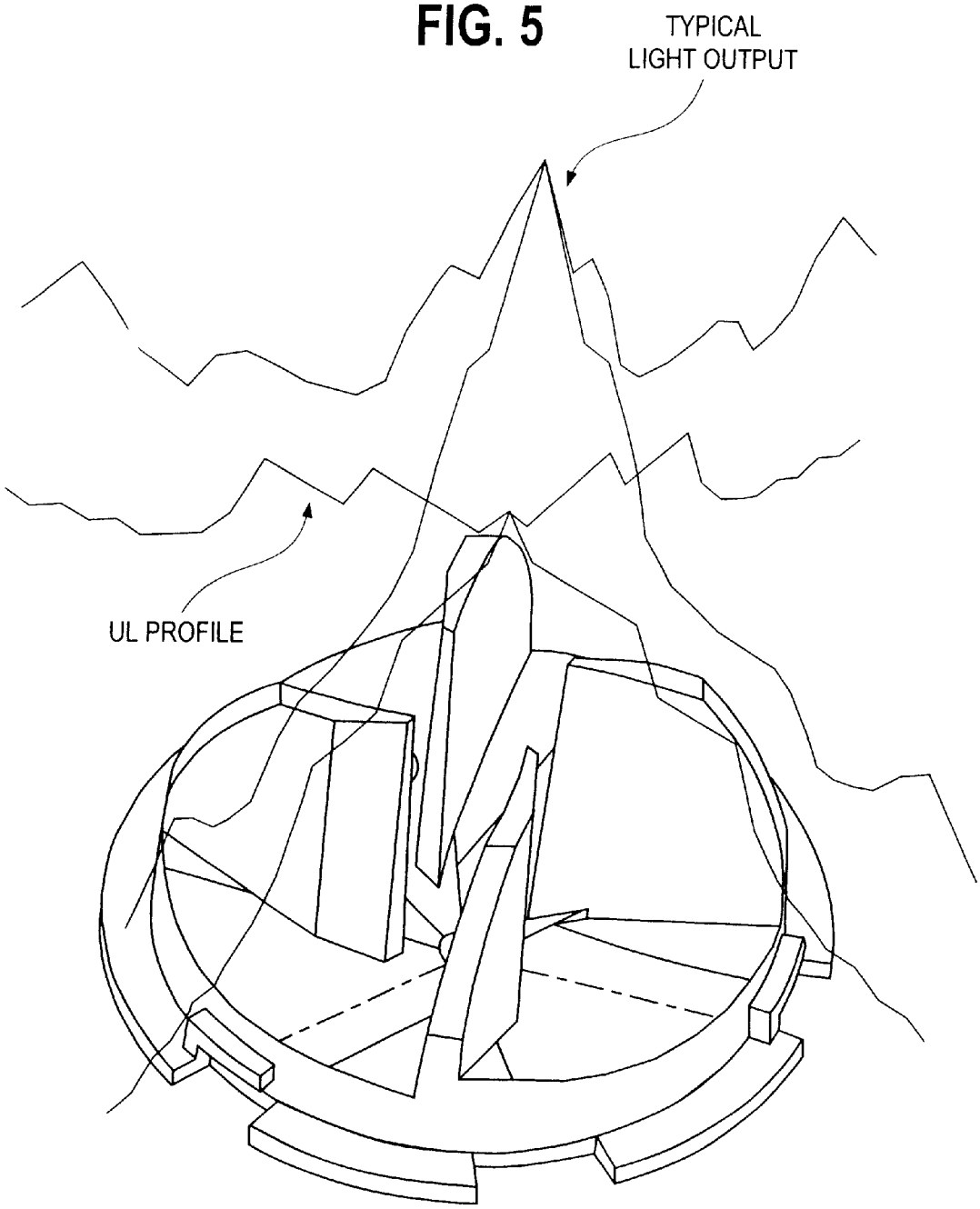
FIG. 5 is a perspective view of the strobe unit of FIG. 1 illustrating light output in two perpendicular vertical planes.
Figure 6:
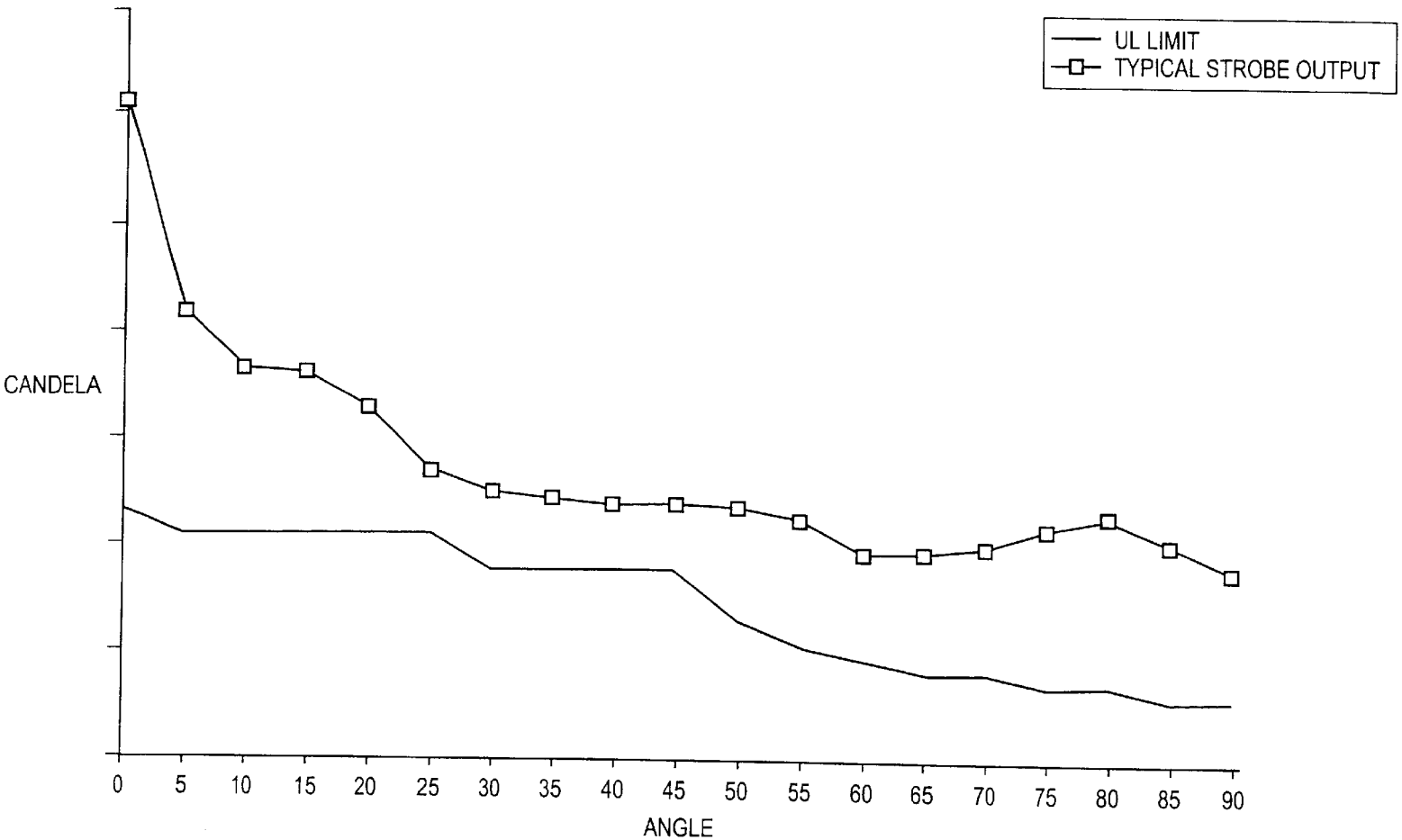
FIG. 6 is a graphical representation of the light output of the strobe unit shown in FIG. 1, observed in one central vertical plane, taken on only one side of a central axis, compared to a corresponding UL requirement.

FIG. 4 illustrates a typical light output along either plane PA or plane PB of the reflector of FIG. 2. FIG. 4 also illustrates relative light output required by U.L. Standard 1971. FIG. 5 is a perspective view illustrating typical light output and UL profiles along planes PA and PB for the reflector of FIG. 2. FIG. 6 illustrates these two profiles for a single quadrant.

Figure 7:
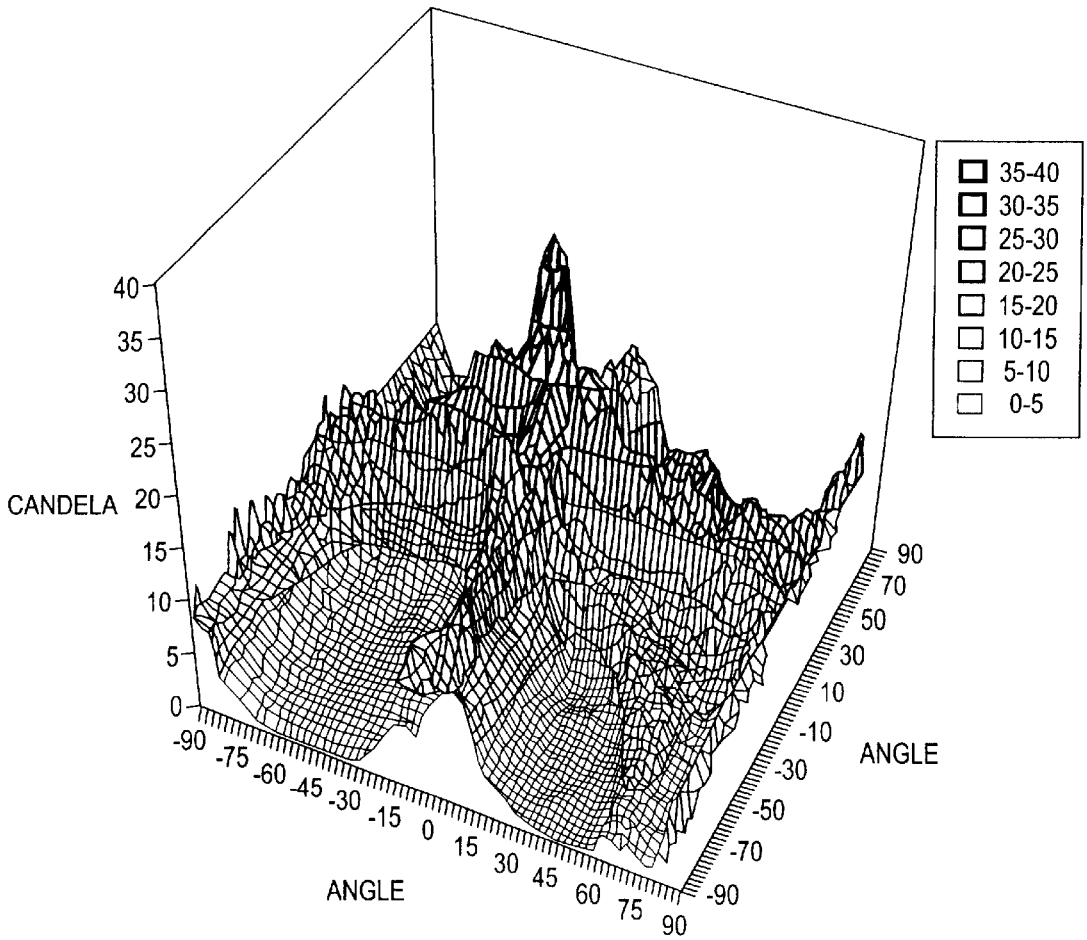
FIG. 7 is a three dimensional graphical display of the light output of the strobe unit of FIG. 1.

FIG. 7 illustrates light output in the entire hemisphere with planes PA and PB running through a 0° angle. Light is emitted to the majority of the hemisphere but is concentrated along planes PA and PB.

Figure 9:
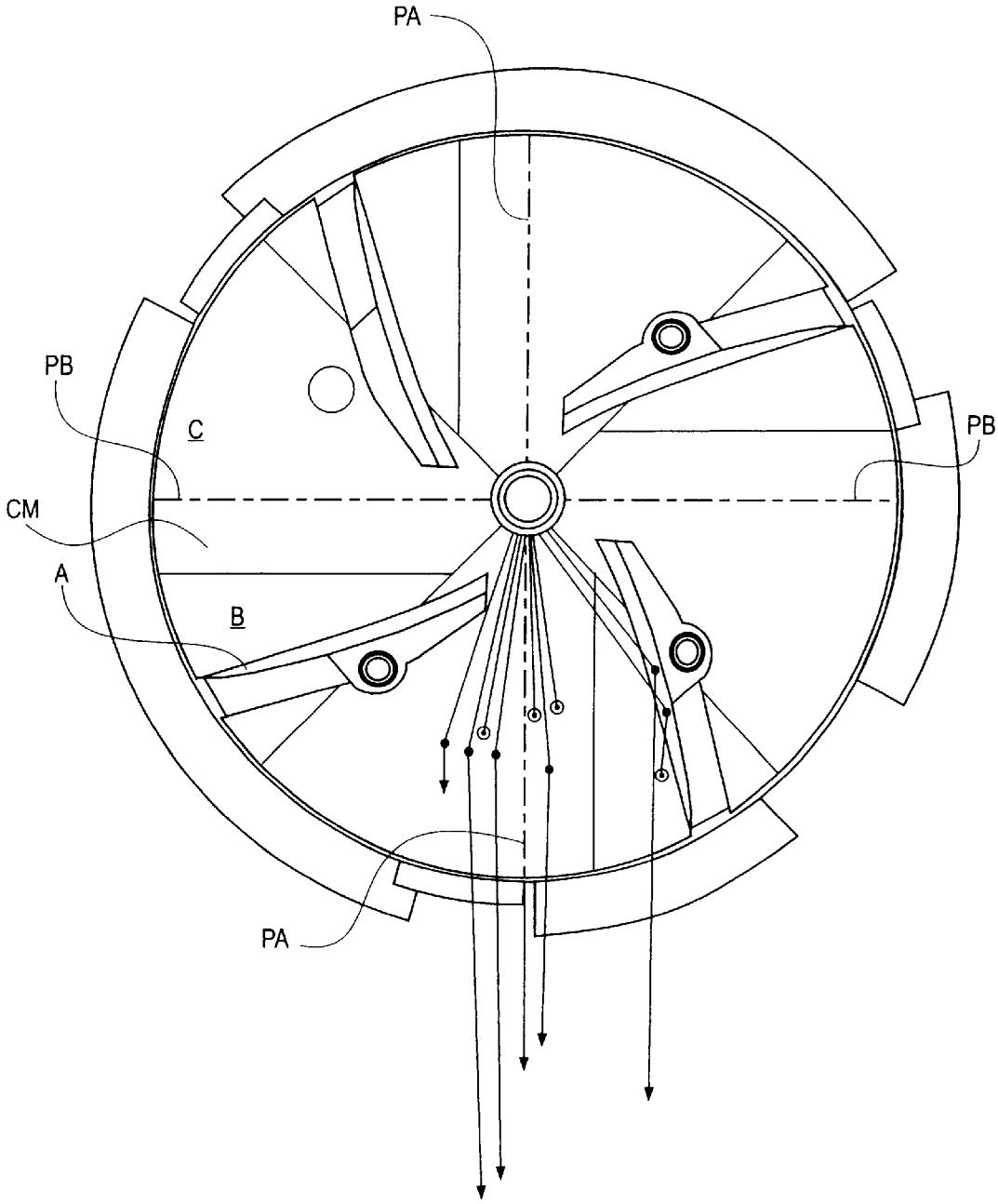
FIG. 9 is a plan view of the reflector shown in FIG. 9 illustrating representative light rays and reflection paths.

FIGS. 8–10 illustrate exemplary rays of light directed to and reflected off of the sections of the reflector of FIG. 2.

Figure 11:
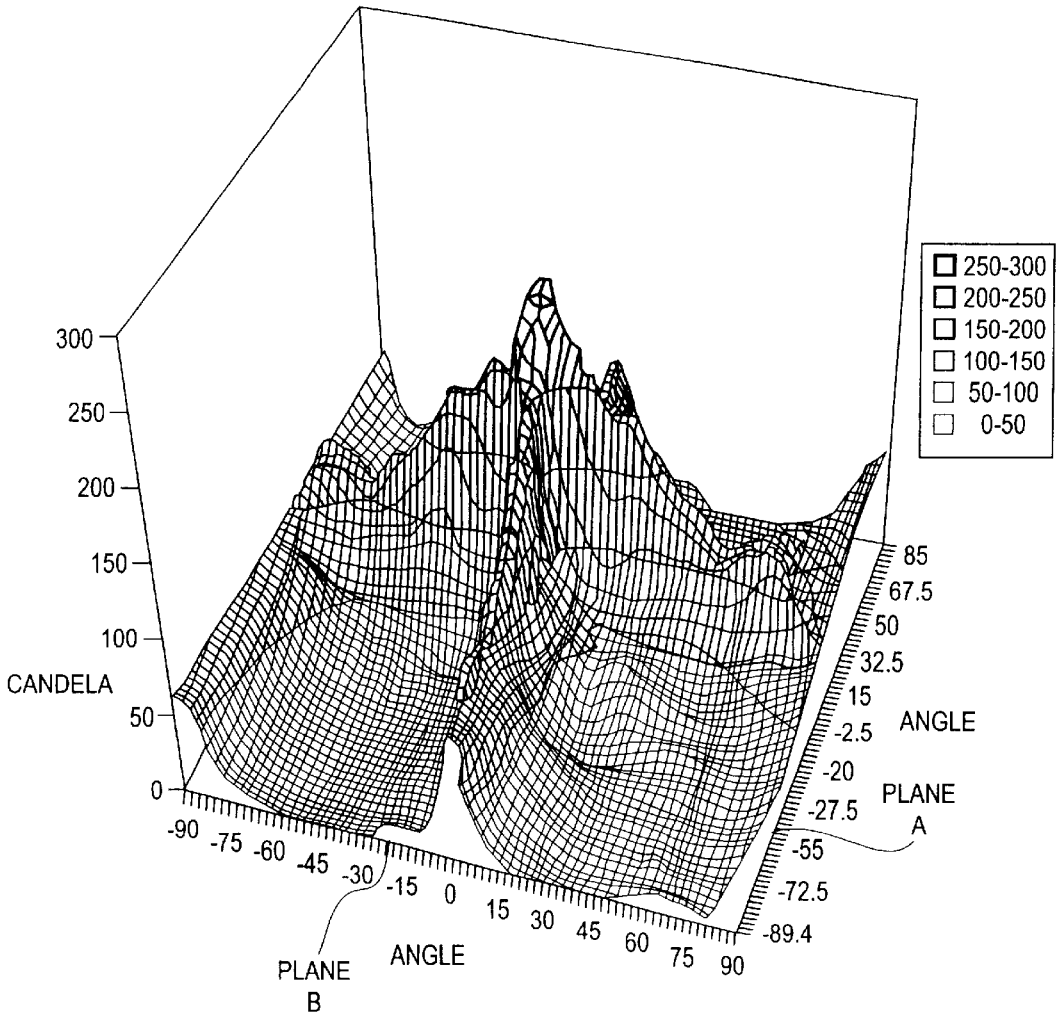
FIG. 11 is a three dimensional graphical display of the light output of the strobe unit of FIG. 9.

FIG. 11 illustrates an output profile for the reflector of FIG. 2 with a higher candela output lamp.

Figure 12:
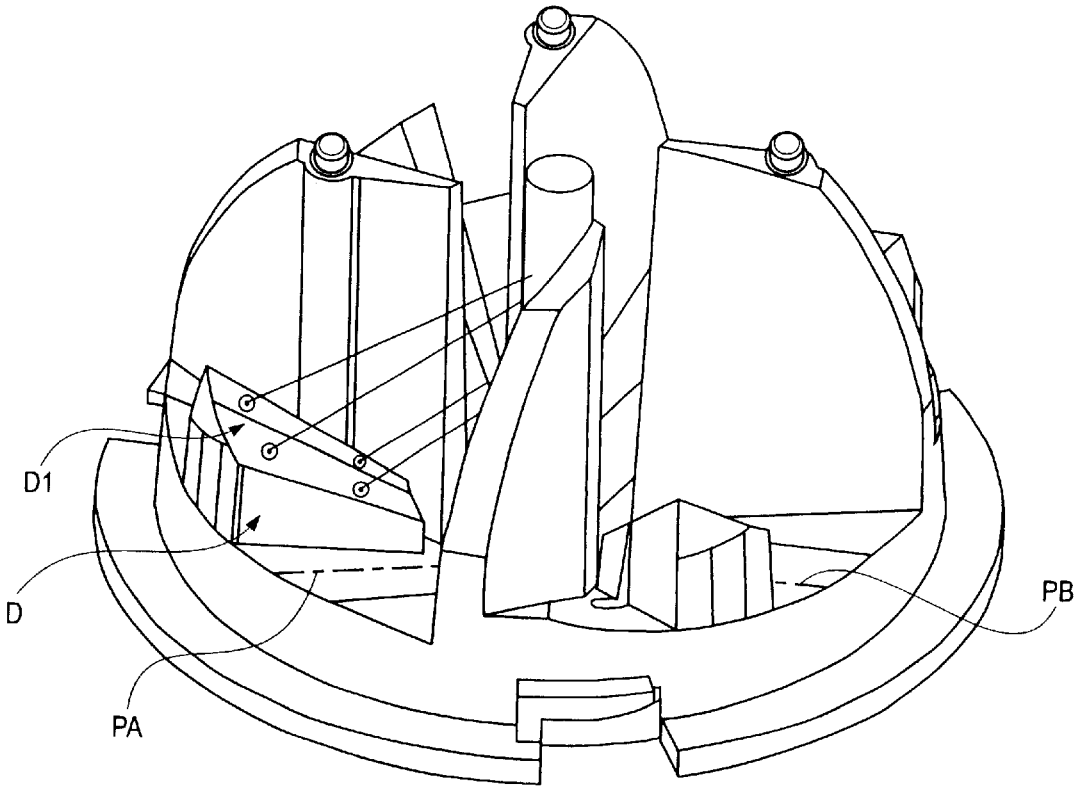
FIG. 12 is a perspective view of an alternate embodiment reflector, shown in an inverted orientation for convenience of description, and illustrating representative light rays and reflection paths.

FIG. 12 illustrates an alternate reflector 160 similar to the reflector 60 shown in FIG. 2, but with an additional elevated structure D having an aiming parabolic surface D1. The surface D1 directs light generally to the compound 45°, i.e., a direction that is 45° from the central axis 64*a* of the bulb and 45° from planes PA and PB.

Figure 12A:
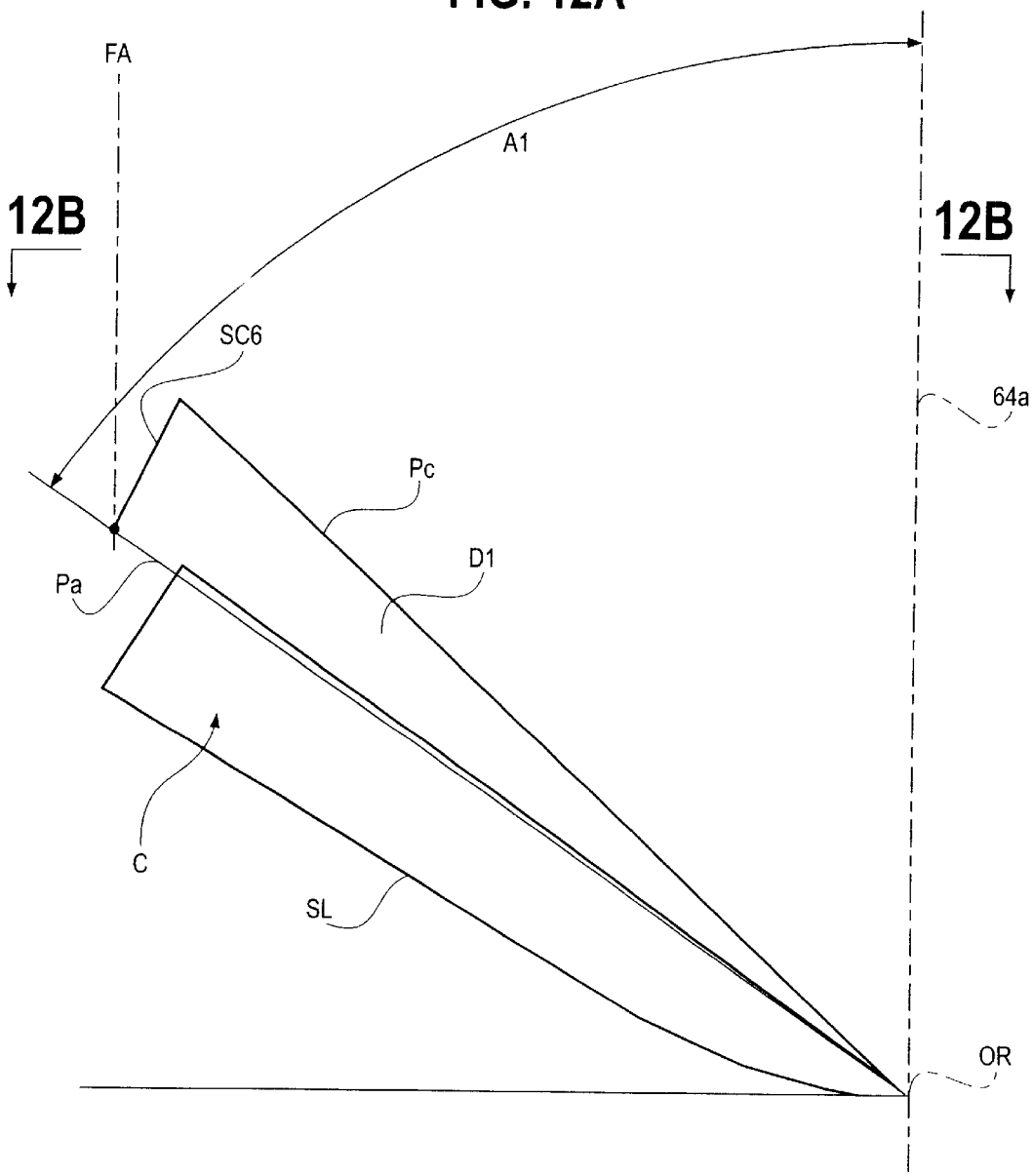
FIG. 12A is a diagrammatic side view of surfaces to used to define a portion of the alternate embodiment reflector of FIG. 12.
Figure 12B:
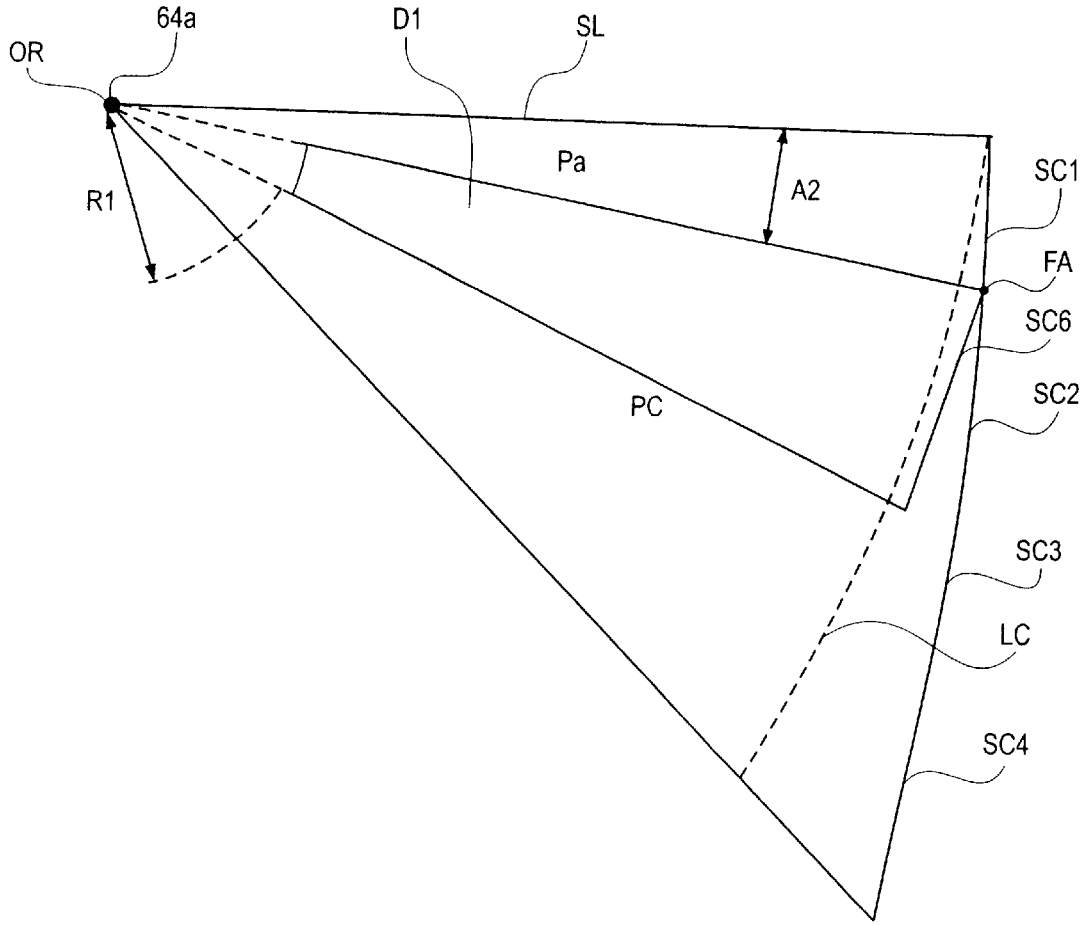
FIG. 12B is a diagrammatic top view taken along line 12B—12B of FIG. 12A.

FIGS. 12A and 12B illustrate the procedure used to define the surface D1. The surface D1 is added to, or overlaid on, the surface C already defined as per FIGS. 2A–2C. To begin defining the surface D1, a projection line Pa is arranged in a plane with the sweep line SL of the surface C, canted at an angle A1 to the central axis 64*a* as shown in FIG. 12A, preferably canted at about 55 degrees.

For a reflector having a 1.9 inch diameter, a partial parabolic surface sc6 having a chord length of about 0.27 inches, having a vertical focal axis FA that is parallel to the central axis 64*a*, having a focal distance of about 1.1 inches, and having an aiming direction d6 of about 25 degrees from the focal axis, is connected to the projection line Pa at the focal axis FA (shown as a dot in FIG. 12B, as it is coming out of the page). The projection line Pa and the curve sc6 are then rotated together by an angle A2, preferably about 10 degrees, about the central axis 64*a* to the position shown in FIGS. 12A and 12B. The curve sc6 is then projected down to the origin OR from the projection line Pa to a terminal projection line Pc at an end of the curve sc6, to form the surface D1. The surface D1 is then trimmed at an inward end about a radius R1, R1 preferably about 0.35 inches. The surface D1 is also trimmed at an outward end, as described in FIG. 2C, along the circular diameter limit LC.

FIGS. 13 through 17 illustrate aspects of an alternate reflector 260. The reflector 260 is formed with four identical reflector quadrants 270, 272, 274, 276 arranged around an elongated, axially oriented light bulb 64.

Surface A is identical to surface A of FIG. 2 previously described.

Surface B' (see FIG. 13A) is a hybrid surface formed by a conical section C5 and an aiming parabolic section C1". The aiming parabolic section C1" and the conical section C5 are formed by a complex curve line or sweep line SL1 formed by a partial parabolic curve sc1 and a line sc5, connected at a tangency point TP, as shown in FIG. 15, the complex curve line or sweep line SL1 being rotated about the origin point OR at the base of the bulb to define the surface B'.

The line sc5 of the conical section C5 is angled toward the origin OR (see FIG. 15) at an angle B2 from the axis 64*a*. The aiming parabolic section C1" and the conical section C5 are tangentially contiguous along a circular segment TL (see FIG. 13A) represented in FIG. 15 by the tangency point TP.

The angle B2 is preferably about 65 degrees. The aiming direction al of the partial parabolic curve sc1 of the section C1" is preferably parallel to the central axis 64*a*, i.e., 0 degrees relative thereto. A light ray emitted from the focal point F on the focal axis FA, in this case the axis 64*a*, would be reflected by the parabolic curve in the aiming direction al, 0 degrees from the axis 64*a*. The distance between the focal point F and the origin OR in FIG. 15 is between 0.5 and 0.55 inches.

Figure 13:
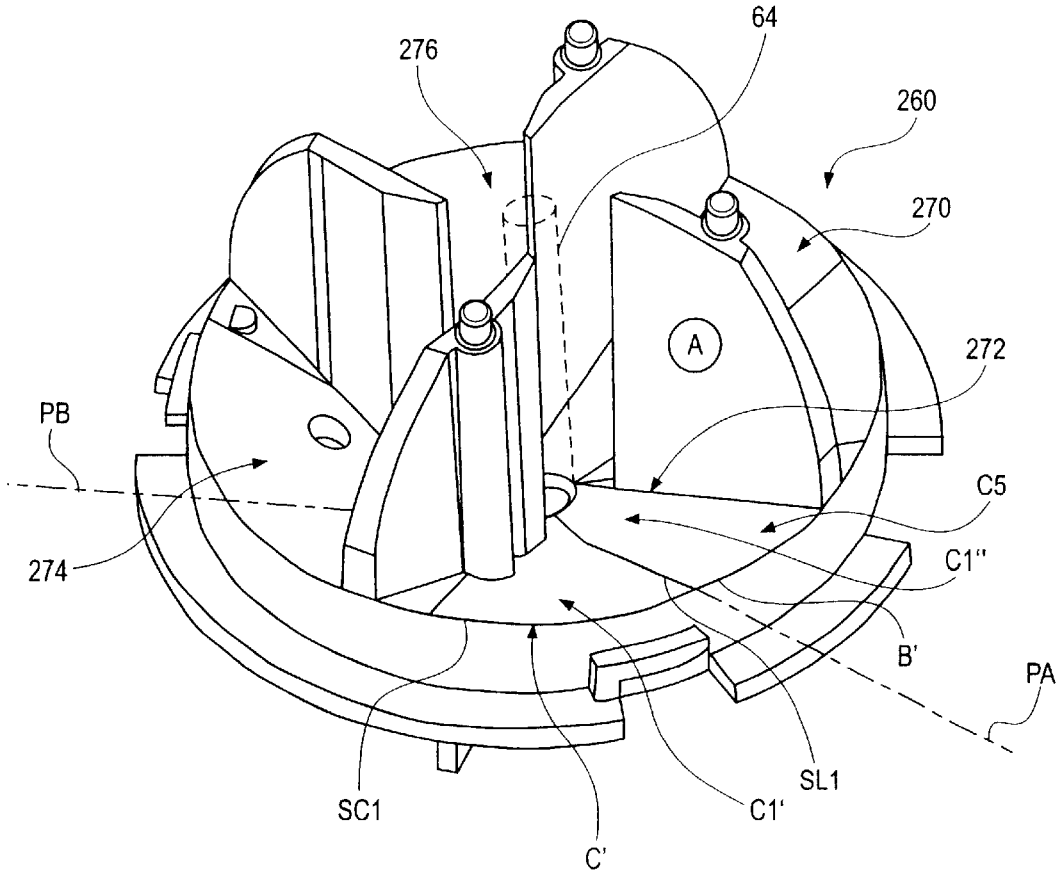
FIG. 13 is a perspective view of a further alternate embodiment reflector, shown in an inverted orientation for convenience of description.
Figure 13A:
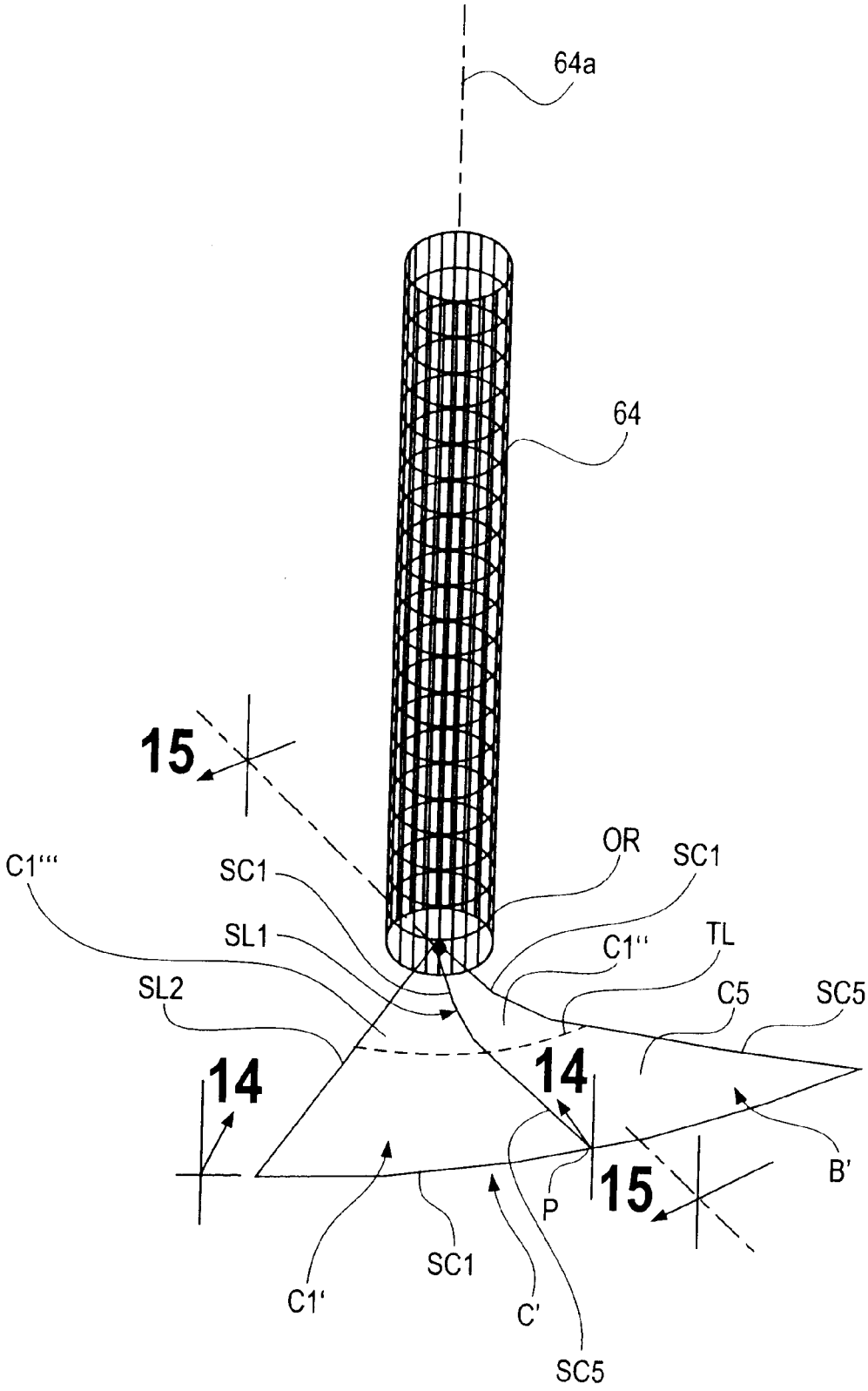
FIG. 13A is a diagrammatic fragmentary perspective view of a portion of the strobe unit shown in FIG. 13.
Figure 14:
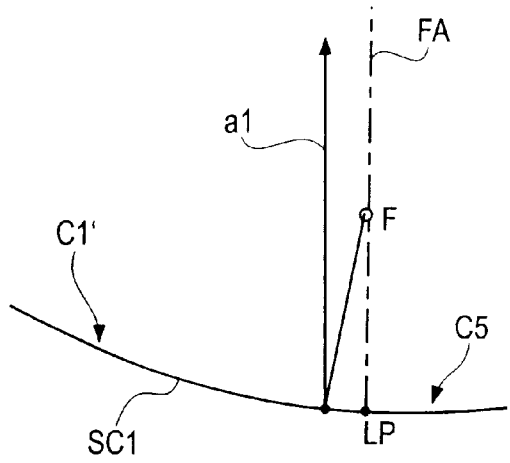
FIG. 14 is a diagrammatic sectional view of a parabolic section taken generally along line 14—14 in FIG. 13A.
Figure 15:
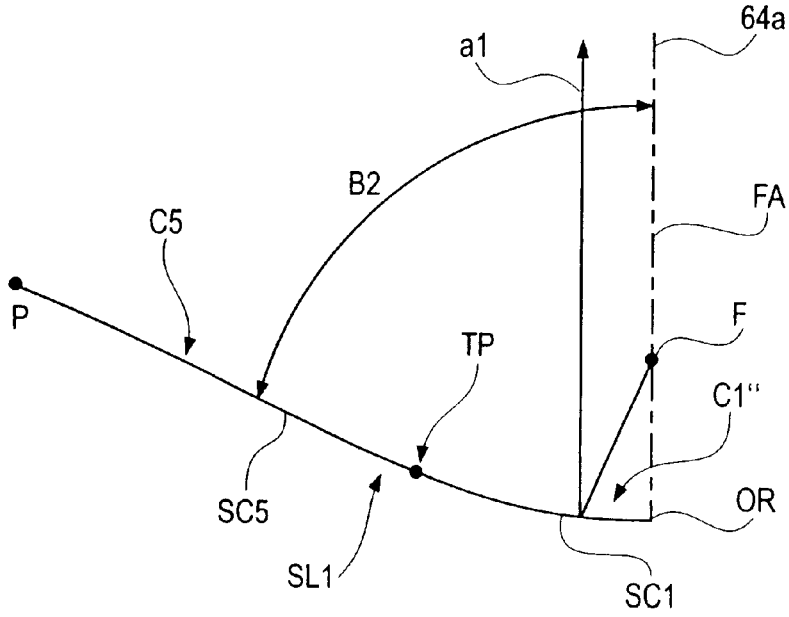
FIG. 15 is a diagrammatic sectional view of a parabolic section taken generally along line 15—15 in FIG. 13A.

The reflector 260, illustrated in FIGS. 13–15, includes an aiming parabolic section C' that includes a surface C1' formed by a partial parabolic curve sc1 as shown in FIG. 14, projected to the origin OR between the sweep line SL1 to a sweep line SL2. The sweep line SL1 is formed by the line sc5 and the partial parabolic curve sc1 of the surface C1" as shown in FIG. 15. The sweep line SL2 is linear.

The surface C1' is defined or formed by the same geometric method described with regard to the creation of the surface C1 in FIGS. 2A, 2B, 2C. The focal axis FA of the partial parabolic curve sc1 of the surface C1' is perpendicular to the line sc5 of the sweep line SL1 and in a plane with the bulb axis 64*a*. The aiming directions a1 of the partial parabolic curve sc1 of the surface C1' is preferably zero degrees with respect to its focal axis FA. The distance between P and F is also about 1.1 inches for a reflector diameter DM equal to 1.9 inches. The chord length Lsc1 for the partial parabolic curve sc1 is 0.9 to 1.0 inches chord length as defined in the first embodiment (FIG. 2A). The sweep line SL used in FIGS. 2B and 2C is replaced by the sweep line SL1 of FIGS. 13 and 13A, particularly the linear portion, line sc5, of the sweep line SL1. In plan, the sweep line SL1 of each quadrant falls on one of the major axes PA, PB as defined in the first embodiment (FIG. 3).

One difference between the surface C1' and C1 is that the sweep line SL1 is not entirely linear, given the presence of the parabolic region C1". The partial parabolic curve sc1 of section C1' is projected obliquely radially to the origin OR to create surface C1', wherein in a region C1"' adjacent to the surface C1", the curve is gradually distorted to gradually blend the surface C1' to smoothly transition into the surface C1". When the surface C1' is constructed as described, the linear sweep line SL2 is oriented radially at the oblique angle X to the axis 64*a*, (as shown in FIG. 2B) to the origin OR. Given that the preferred angle B2 of the line sc5 is about 65 degrees, the angle X will be somewhat less than 65 degrees.

Surfaces C2, C3 and C4 as previously described in the first embodiment are not employed in this particular embodiment.

Figure 16:
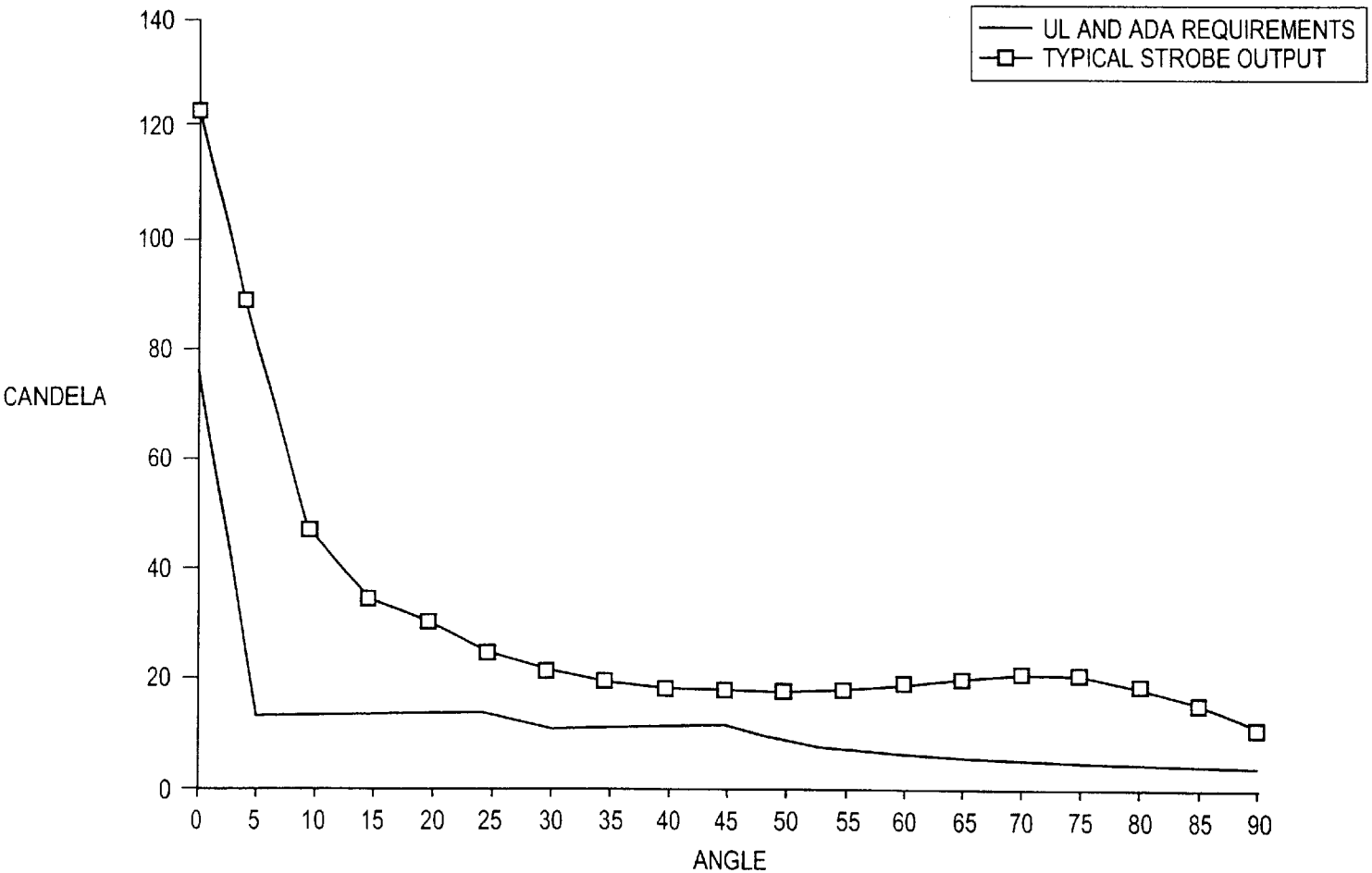
FIG. 16 is a graphical representation of the light output of the strobe unit shown in FIG. 13, compared to UL and Americans With Disabilities Act (ADA) requirements.

FIG. 16 illustrates light output for each of the quadrants of the reflector of FIG. 13 versus the UL and Americans With Disabilities Act (ADA) required outputs.

Figure 17:
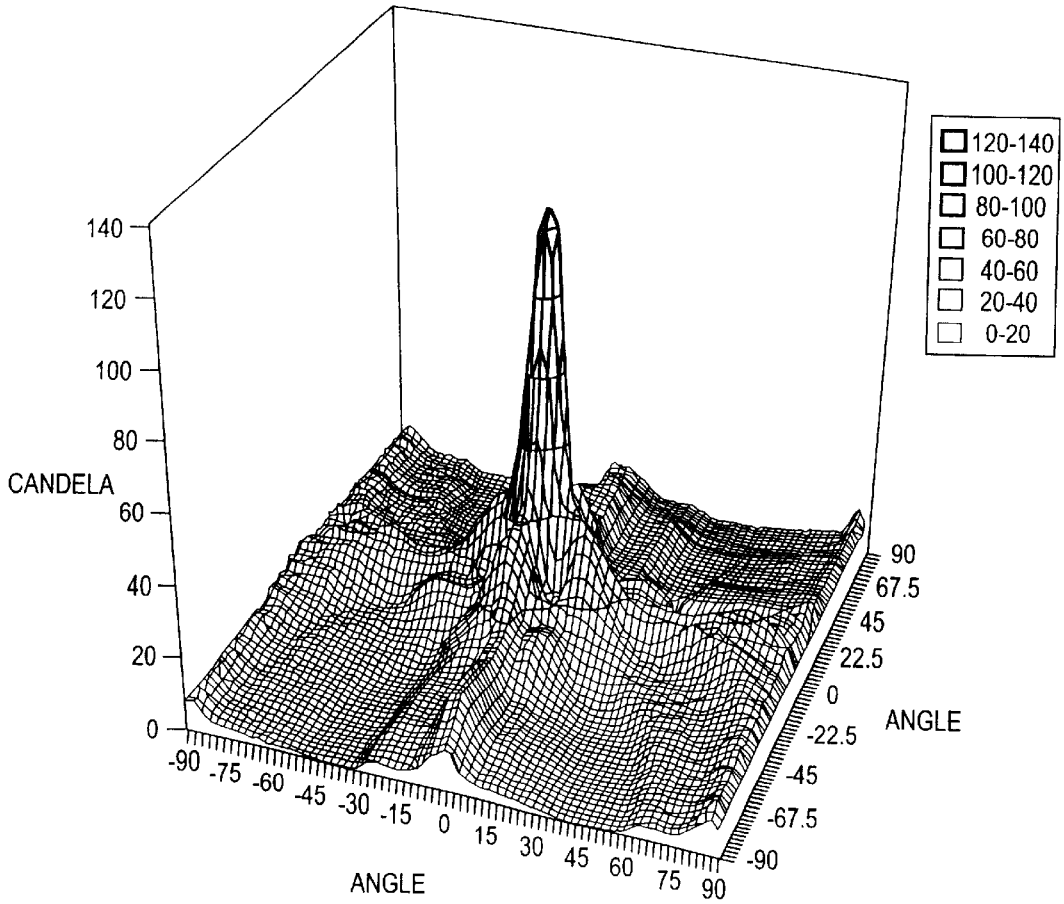
FIG. 17 is a three dimensional graphical display of the light output of the strobe unit of FIG. 13.

FIG. 17 illustrates light output for the reflector of FIG. 13 in the entire hemisphere with planes PA and PB running through the 0 degree angles. Light is emitted to the majority of the hemisphere but is concentrated along planes PA and PB.

From the foregoing, it will be observed that numerous variations and modifications may be effected without departing from the spirit and scope of the invention. It is to be understood that no limitation with respect to the specific apparatus illustrated herein in tended or should be inferred. It is, of course, intended to cover by the appended claims all such modifications as fall within the scope of the claims.

What is claimed is:

1. A strobe unit comprising:

a light source;

a reflector having a central axis extending in a first direction and a plurality of reflecting regions arranged around said central axis, each reflecting region including a partial parabolic surface elongated linearly substantially in said first direction, and a plurality of parabolic aiming surfaces which are projected substantially radially from a periphery of the reflector to a point on the central axis and arranged between adjacent partial parabolic surfaces, said parabolic aiming surfaces are arranged to reflect light from said light source substantially in a radial plane substantially parallel to said first direction, each adjacent pair of reflecting regions is separated by a common one of the partial parabolic surfaces.

2. The strobe unit according to claim 1, wherein each reflecting region comprises a planar surface arranged between said partial parabolic surface and said parabolic aiming surface.

3. The strobe unit according to claim 1, wherein said light source is an elongated bulb, elongated in said first direction and located along said central axis.

4. A strobe unit comprising:

a light source;

a reflector having a central axis extending in a first direction and a plurality of reflecting regions arranged around said central axis, each reflecting region including a partial parabolic surface elongated linearly substantially in said first direction, and a plurality of parabolic aiming surfaces which are projected substantially radially from a periphery of the reflector to a point on the central axis and arranged between adjacent partial parabolic surfaces, said parabolic aiming surfaces are arranged to reflect light from said light source substantially in a radial plane substantially parallel to said first direction;

wherein said parabolic aiming surfaces comprise four successively contiguous surfaces, said four successively contiguous surfaces are formed by projecting partial parabolic curves to the central axis, said partial parabolic curves having aiming directions at angles of 0°, 10°, 20°, and 30° respectively, from a common focal axis, said angles listed successively moving away rotationally from said partial parabolic surface.

5. A strobe unit comprising:

a light source;

a reflector having a central axis extending in a first direction and a plurality of reflecting regions arranged around said central axis, each reflecting region including a partial parabolic surface elongated linearly substantially in said first direction, and a plurality of parabolic aiming surfaces which are projected substantially radially from a periphery of the reflector to a point on the central axis and arranged between adjacent partial parabolic surfaces, said parabolic aiming surfaces are arranged to reflect light from said light source substantially in a radial plane substantially parallel to said first direction;

wherein each reflecting region comprises a raised parabolic aiming surface spaced from said partial parabolic surface and curved and oriented to reflect light from the bulb generally along the compound 45° direction.

6. The strobe unit according to claim 5, wherein said parabolic aiming surfaces comprise four successively contiguous surfaces, said four successively contiguous surfaces formed by projecting partial parabolic curves to the central axis, said partial parabolic curves having aiming directions at angles of 0°, 10°, 20°, and 30° respectively, from a common focal axis, said angles listed successively moving away rotationally from said partial parabolic surface.

7. The strobe unit according to claim 5, wherein each reflecting region comprises a planar surface arranged between said partial parabolic surface and said parabolic aiming surface.

8. A strobe unit comprising:

a light source;

a reflector having a central axis extending in a first direction and a plurality of reflecting regions arranged around said central axis, each reflecting region including a partial parabolic surface elongated linearly substantially in said first direction, and a plurality of parabolic aiming surfaces which are projected substantially radially from a periphery of the reflector to a point on the central axis and arranged between adjacent partial parobolic surfaces, said parobolic aiming surfaces are arranged to reflect light from said light source substantially in a radial plane substantially parallel to said first direction;

wherein said parabolic aiming surface comprises two parabolic aiming surfaces located between the adjacent partial parobolic surfaces.

9. A strobe unit comprising:

a light source;

a reflector having a central axis extending in a first direction and a plurality of reflecting regions arranged around said central axis, each reflecting region including a partial parabolic surface elongated linearly substantially in said first direction, and a plurality of parabolic aiming surfaces which are projected substantially radially from a periphery of the reflector to a point on the central axis and arranged between adjacent partial parabolic surfaces, said parabolic aiming surfaces are arranged to reflect light from said light source substantially in a radial plane substantially parallel to said first direction;

wherein said two parabolic aiming surfaces include a first parabolic aiming surface formed by a first partial parabolic curve projected radially, obliquely substantially to a point on the central axis and a second parabolic aiming surface formed by a second partial parabolic curve rotated about a focal axis, said focal axis coincident with said central axis.

10. The strobe unit according to claim 9, comprising a frustoconical reflector blended into said first partial parabolic aiming surface along a line of tangency and contiguous with said second parabolic aiming surface around a circular segment of tangency.

11. A strobe unit comprising:

a light source;

a reflector having a central axis extending in a first direction and a plurality of reflecting regions arranged around said central axis, each reflecting region including a partial parabolic surface elongated linearly substantially in said first direction, adjacent reflecting regions are separated by a respective partial parabolic surface, and a plurality of radially projected reflecting surfaces wherein each is arranged between adjacent partial parabolic surfaces, said parabolic aiming surfaces arranged to reflect light from said light source substantially in a radial plane substantially parallel to said first direction.

12. A strobe unit comprising:

a lamp elongated in a first direction;

a reflector having a plurality of reflecting regions arranged spaced around said lamp, said reflecting regions each including an upstanding partial parabolic surface elongated linearly substantially along said first direction and arranged to reflect light from said lamp radially outwardly; and including flat reflecting surfaces adjacent to respective base ends of said partial parabolic surfaces, said flat surfaces angled at about 65 to 75 degrees to the first direction, and parabolic aiming surfaces projected from a periphery of the reflector linearly substantially radially to a point, said parabolic aiming sections arranged adjacent to said flat surfaces.

13. The strobe unit according to claim 12, wherein said parabolic aiming surfaces comprise four successively contiguous surfaces, said four successively contiguous surfaces formed by projecting partial parabolic curves to the central axis, said partial parabolic curves having aiming directions at angles of 0°, 10°, 20°, and 30° respectively, from a common focal point, said angles listed successively moving away rotationally from said partial parabolic surface.

14. A reflector intended to be mounted on a generally horizontal surface comprising:

a base;

an elongated source of illumination with a central axis oriented perpendicular to the base, carried on the base; and a plurality of substantially identical regions wherein the members of the plurality surround the source wherein each member of the plurality includes a singular partial parabolic surface oriented generally parallel to the central axis of the source, and a plurality of connected partial parabolic surfaces which extend at an acute angle from the source, generally perpendicular to the singular partial parabolic surface, the acute angle falls in a range from fifty to seventy degrees.

15. A reflector as in claim 14 which includes a planar element in each member of the plurality, located between the singular partial parabolic surface and the plurality of connected surfaces wherein the planar element extends from the axis at an angle about equal to the acute angle.

16. A reflector as in claim 14 wherein first and second singular partial parabolic surfaces are positioned adjacent to, and extend along, opposite sides of a plane through the axis, on opposite sides of the source.

17. A reflector as in claim 16 wherein the source is directly visible for direct viewing from a variety of positions defining a viewing angle range, said range being between about thirty to ninety degrees between each singular partial parabolic surface, the source, and an adjacent singular partial parabolic surface.

18. A reflector as in claim 17 wherein the angle range is about 65 degrees.

19. A reflector as in claim 14 wherein the acute angle is about 60 degrees.

20. A reflector as in claim 14 wherein the singular partial parabolic section in each respective member of the plurality is elongated linearly in a direction substantially perpendicular to the base.

21. A reflector as in claim 20 wherein the acute angle falls in a range from 50 to 70 degrees.

22. A reflector as in claim 14 wherein the members of the plurality of regions are configured, relative to the source, to generate two substantially identical, perpendicular illumination profiles.

23. A reflector as in claim 22 wherein the source is directly visible for direct viewing from a variety of positions defining a viewing angle range, said range being between about thirty to ninety degrees between each singular partial parabolic surface, the source, and an adjacent singular partial parabolic surface.

24. A reflector as in claim 22 which includes in each member of the plurality an additional reflective element to provide enhanced illumination in a direction generally forty five degrees from at least one of the profiles.

25. A reflector as in claim 24 wherein the additional reflective element directs additional light to the compound forty five degree direction.

26. A reflector as in claim 25 wherein the additional reflective element is oriented at an acute angle relative to the base.

27. A reflector as in claim 14 wherein the plurality of connected sections includes at least two partial parabolic surfaces which extend from the source wherein each is bounded by first and second lines which extend from the source.

28. A reflector as in claim 27 wherein the plurality of connected sections includes at least four partial parabolic surfaces.

29. A reflector comprising:

a plurality of modules radially disposed about a central axis wherein each module includes multiple reflective elements generally disposed perpendicular to the axis, with at least one disposed parallel thereto wherein each module exhibits a generally L-shaped reflective composite surface with an open side, each adjacent pair of modules is substantially bounded on a common side by an element reflective on at least one side.

30. A reflector as in claim 29 which comprises four modules arranged radially about the axis.

31. A reflector as in claim 29 which includes at least two modules arranged on a line perpendicular to the axis.

32. A reflector as in claim 31 wherein the at least one element in each module has a partial parabolic cross section with an axis thereof extending substantially parallel to the central axis.

33. A reflector as in claim 32 wherein at least one of the multiple reflective elements is planar and extends at an acute angle relative to the central axis.

34. A reflector as in claim 33 which includes a mounting base oriented generally perpendicular to the central axis.

35. A reflector as in claim 33 wherein the modules symmetrically emit light with a selected profile, relative to the central axis, in a plane which includes the central axis.

36. A reflector as in claim 35 which includes at least two additional modules which symmetrically emit light with the profile relative to the central axis in a second plane which includes the central axis.

37. A reflector as in claim 36 which includes an elongated radiant energy source which extends along the central axis.

38. A reflector as in claim 37 wherein the source has first and second spaced apart ends and is restrained at each end.

39. A reflector as in claim 33 wherein the planar element is arcuately displaced from the parabolic element at an end displaced from the central axis.

40. A reflector as in claim 39 which includes at least two elongated partial parabolic elements located between the planar element and an end of the parabolic element.

41. A reflector as in claim 39 wherein the planar element is bounded by first and second edges which are oriented at an acute angle to one another.

42. A reflector as in claim 40 wherein the at least two elongated partial parabolic elements are bounded by first and second edges which are oriented at an acute angle to one another.

43. A strobe unit, attachable to a generally horizontal surface, comprising:

a base attachable to the surface; and a reflector carried on the base, symmetrical relative to a center line perpendicular to the base, wherein the reflector includes a plurality of L-shaped modules wherein each module includes at least one curved reflector element oriented on the order of ninety degrees relative to a plurality of different reflector elements.

44. A unit as in claim 43 wherein the modules are arcuately disposed about the center line.

45. A unit as in claim 43 which includes an elongated source carried on the base and extending along the center line.

46. A unit as in claim 43 wherein the curved reflector elements are arranged on the order of ninety degrees to one another.

47. A unit as in claim 43 wherein the reflector comprises at least three modules.

48. A unit as in claim 47 wherein the modules provide substantially identical output profiles in two planes that are perpendicular to one another.

49. A unit as in claim 48 wherein the planes intersect at the centerline.

50. A unit as in claim 49 which includes at least four modules.

51. A unit as in claim 49 wherein each module includes a curved reflector element which extends generally parallel to the centerline and wherein the curved reflector elements are arranged on the order of ninety degrees to one another.

* * * * *